US010852042B2

(12) United States Patent
Honda et al.

(10) Patent No.: US 10,852,042 B2
(45) Date of Patent: Dec. 1, 2020

(54) AIR CONDITIONING SYSTEM

(71) Applicant: DAIKIN INDUSTRIES, LTD., Osaka (JP)

(72) Inventors: Masahiro Honda, Osaka (JP); Shigeki Kamitani, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 177 days.

(21) Appl. No.: 15/738,396

(22) PCT Filed: Jun. 15, 2016

(86) PCT No.: PCT/JP2016/067799

§ 371 (c)(1),
(2) Date: Dec. 20, 2017

(87) PCT Pub. No.: WO2016/208470

PCT Pub. Date: Dec. 29, 2016

(65) Prior Publication Data

US 2018/0180338 A1 Jun. 28, 2018

(30) Foreign Application Priority Data

Jun. 26, 2015 (JP) ..... 2015-128665

(51) Int. Cl.

| | |
|---|---|
| ***F25B 49/02*** | (2006.01) |
| ***F25B 41/04*** | (2006.01) |
| ***F24F 11/89*** | (2018.01) |
| ***F25B 13/00*** | (2006.01) |

(52) U.S. Cl.

CPC ..... *F25B 49/02* (2013.01); *F24F 11/89* (2018.01); *F25B 13/00* (2013.01); *F25B 41/04* (2013.01);

(Continued)

(58) Field of Classification Search

CPC .... F25B 49/02; F25B 13/00; F25B 2313/006; F25B 2313/0314; F25B 2313/0315;

(Continued)

(56) References Cited

U.S. PATENT DOCUMENTS

2011/0000234 A1* 1/2011 Nishimura ..... F25B 49/005 62/77

FOREIGN PATENT DOCUMENTS

EP 2 256 423 A1 12/2010
EP 2 426 438 A2 3/2012

(Continued)

OTHER PUBLICATIONS

English Translation of JP2013019621A.*

(Continued)

*Primary Examiner* — Marc E Norman
*Assistant Examiner* — Schyler S Sanks
(74) *Attorney, Agent, or Firm* — Birch, Stewart, Kolasch & Birch, LLP

(57) ABSTRACT

As a shut-off valve inspection process for checking operation of a liquid side shut-off valve and a gas side shut-off valve, an air conditioning system operates a compressor in a cooling cycle state, performs opening and closing operation of the liquid side shut-off valve and the gas side shut-off valve, and determines whether the liquid side shut-off valve and the gas side shut-off valve properly operate on the basis of a temperature value detected by a temperature sensor provided in an indoor unit.

20 Claims, 13 Drawing Sheets

(52) U.S. Cl.
CPC . *F25B 2313/006* (2013.01); *F25B 2313/0314* (2013.01); *F25B 2500/221* (2013.01); *F25B 2500/222* (2013.01); *F25B 2600/23* (2013.01); *F25B 2600/2501* (2013.01); *F25B 2600/2519* (2013.01); *F25B 2700/2104* (2013.01)

(58) Field of Classification Search
CPC ..... F25B 2500/221; F25B 2500/222; F25B 2500/22; F25B 2600/2519; F25B 2700/2104; F25B 2700/21174; F25B 2700/21175; F24F 11/89
See application file for complete search history.

(56) References Cited

FOREIGN PATENT DOCUMENTS

| | | | | | |
|---|---|---|---|---|---|
| JP | 6-300397 | A | | 10/1994 | |
| JP | 7-55299 | A | | 3/1995 | |
| JP | 2002-71188 | A | | 3/2002 | |
| JP | 2002-243240 | A | | 8/2002 | |
| JP | 2002243240 | A | * | 8/2002 | |
| JP | 2007-333219 | A | | 12/2007 | |
| JP | 2007333219 | A | * | 12/2007 | ..... F25B 49/005 |
| JP | 2009-145005 | A | | 7/2009 | |
| JP | 2009-243720 | A | | 10/2009 | |
| JP | 2013-19621 | A | | 1/2013 | |
| JP | 2013019621 | A | * | 1/2013 | |

OTHER PUBLICATIONS

English Translation of JP2007333219A.*
English Translation of JP2002243240A.*
Extended European Search Report dated May 18, 2018 issued in corresponding EP Application No. 16814241.2.

* cited by examiner

AIR CONDITIONING SYSTEM

TECHNICAL FIELD

The present invention relates to an air conditioning system which includes a refrigerant circuit configured by connecting an outdoor unit having a compressor and an outdoor heat exchanger to an indoor unit having an indoor heat exchanger via refrigerant communication pipes and which is provided with a shut-off valve closed when leakage of refrigerant is detected being provided on a liquid refrigerant pipe extending from a liquid side end of the outdoor unit to a liquid side end of the indoor heat exchanger and a shut-off valve closed when leakage of refrigerant is detected being provided on a gas refrigerant pipe extending from a gas side end of the outdoor unit to a gas side end of the indoor heat exchanger.

BACKGROUND ART

Conventional air conditioning systems include a refrigerant circuit configured by connecting an outdoor unit having a compressor and an outdoor heat exchanger to an indoor unit having an indoor heat exchanger via refrigerant communication pipes. Such an air conditioning system can be provided with a shut-off valve closed when leakage of refrigerant is detected being provided on a liquid refrigerant pipe extending from a liquid side end of the outdoor unit to a liquid side end of the indoor heat exchanger and a shut-off valve closed when leakage of refrigerant is detected being provided on a gas refrigerant pipe extending from a gas side end of the outdoor unit to a gas side end of the indoor heat exchanger in order to decrease the amount of refrigerant leakage in the case of the occurrence of leakage of refrigerant. In addition, such an air conditioning system, as disclosed in Patent Document 1 (JP-A-2013-19621), performs opening and closing operation of the shut-off valves during a periodical inspection or the like to determine whether the shut-off valves properly operate using operating noises and/or vibrations of the shut-off valves during this opening and closing operation.

SUMMARY OF INVENTION

However, the above conventional technique for checking the operation of the shut-off valves using operating noises and/or vibrations cannot determine whether the closed shut-off valves are actually in closed states and whether desired shutoff performances (an amount of valve leakage in a closed state etc.) are ensured when the shut-off valves have been closed.

An object of the present invention is to enable operation including shutoff performances of shut-off valves to be reliably checked in an air conditioning system which includes a refrigerant circuit configured by connecting an outdoor unit having a compressor and an outdoor heat exchanger to an indoor unit having an indoor heat exchanger via refrigerant communication pipes and which is provided with shut-off valves closed when leakage of refrigerant is detected being provided on a liquid refrigerant pipe and a gas refrigerant pipe.

An air conditioning system according to a first aspect includes a refrigerant circuit configured by connecting an outdoor unit having a compressor and an outdoor heat exchanger to an indoor unit having an indoor heat exchanger via a liquid refrigerant communication pipe and a gas refrigerant communication pipe. The air conditioning system is provided with a liquid side shut-off valve closed when leakage of refrigerant is detected being provided on a liquid refrigerant pipe including the liquid refrigerant communication pipe and extending from a liquid side end of the outdoor unit to a liquid side end of the indoor heat exchanger and a gas side shut-off valve closed when leakage of refrigerant is detected being provided on a gas refrigerant pipe including the gas refrigerant communication pipe and extending from a gas side end of the outdoor unit to a gas side end of the indoor heat exchanger. In addition, in the air conditioning system, a system control part controlling constituent devices including the liquid side shut-off valve and the gas side shut-off valve performs a shut-off valve inspection process for checking operation of the liquid side shut-off valve and the gas side shut-off valve. Here, the shut-off valve inspection process operates the compressor in the state in which the outdoor heat exchanger functions as a radiator for the refrigerant, performs opening and closing operation of the liquid side shut-off valve and the gas side shut-off valve, and determines whether the liquid side shut-off valve and the gas side shut-off valve properly operate on the basis of a temperature value detected by a temperature sensor provided in the indoor unit.

As described above, in the case in which the shut-off valves operate in the same manner as their opening and closing operation when the opening and closing operation of the shut-off valves has been performed and the compressor operates in the state in which the outdoor heat exchanger functions as a radiator for the refrigerant (a cooling cycle state), since the refrigerant in the indoor unit behaves as expected in accordance with the proper operation of the shut-off valves, the temperature value detected by the temperature sensor provided in the indoor unit varies as expected in accordance with the proper operation of the shut-off valves. On the other hand, in the case in which the shut-off valves do not operate in the same manner as their opening and closing operation, since the refrigerant in the indoor unit does not behave as expected, the temperature value detected by the temperature sensor provided in the indoor unit does not vary as expected either. In this way, when the compressor operates in the cooling cycle state, and the opening and closing operation of the shut-off valves is performed, it can be determined whether the proper operation of the shut-off valves including their shutoff performances is performed on the basis of the temperature value detected by the temperature sensor provided in the indoor unit at this time.

Thus, here, the operation of the liquid side shut-off valve and the gas side shut-off valve including their shutoff performances can be reliably checked.

An air conditioning system according to a second aspect is the air conditioning system according to the first aspect, in which the temperature sensor includes an indoor-heat-exchanger-liquid-side temperature sensor detecting a temperature of the refrigerant on the liquid side end of the indoor heat exchanger and an indoor temperature sensor detecting a temperature of air in the indoor unit. Here, in the shut-off valve inspection process, the system control part operates the compressor in the state in which the outdoor heat exchanger functions as a radiator for the refrigerant in the state in which closing operation of the liquid side shut-off valve and the gas side shut-off valve has been performed. In addition, after starting this operation of the compressor, the system control part determines that the gas side shut-off valve properly operates in the case in which the temperature of the refrigerant detected by the indoor-heat-exchanger-liquid-side temperature sensor after a first predetermined time has elapsed does not vary to equal to or more than a first predetermined temperature, or, in the case in which an absolute value of a difference in temperature between the temperature of the refrigerant detected by the indoor-heat-exchanger-liquid-side temperature sensor and the temperature of the air detected by the indoor temperature sensor after the first predetermined time has elapsed is equal to or less than a first predetermined difference in temperature.

In the case in which the flow of the refrigerant does not occur in the indoor unit, the refrigerant in the indoor unit is in a saturated state at the same temperature as the temperature of the air in the indoor unit. When the closing operation of the liquid side shut-off valve and the gas side shut-off valve has been performed from this saturated state and the compressor operates in the cooling cycle state, the flow of the refrigerant does not occur in the indoor unit as long as the gas side shut-off valve properly operates, and thus, the temperature of the refrigerant on the liquid side end of the indoor heat exchanger remains at the same temperature as the temperature of the air in the indoor unit and does not vary.

For this reason, here, as described above, in the shut-off valve inspection process, the closing operation of the liquid side shut-off valve and the gas side shut-off valve and the operation of the compressor in the cooling cycle state create the situation in which the temperature of the refrigerant on the liquid side end of the indoor heat exchanger remains at the same temperature as the temperature of the air in the indoor unit and does not vary, as long as the gas side shut-off valve properly operates. In addition, here, as described above, in the case in which the temperature of the refrigerant detected by the indoor-heat-exchanger-liquid-side temperature sensor after the first predetermined time has elapsed does not vary to equal to or more than the first predetermined temperature, it is determined that the temperature of the refrigerant on the liquid side end of the indoor heat exchanger remains at the same temperature as the temperature of the air in the indoor unit and does not vary, and that the gas side shut-off valve properly operates. Alternatively, as described above, in the case in which the absolute value of the difference in temperature between the temperature of the refrigerant detected by the indoor-heat-exchanger-liquid-side temperature sensor and the temperature of the air detected by the indoor temperature sensor after the first predetermined time has elapsed is equal to or less than the first predetermined difference in temperature, it is determined that the temperature of the refrigerant on the liquid side end of the indoor heat exchanger remains at the same temperature as the temperature of the air in the indoor unit and does not vary, and that the gas side shut-off valve properly operates.

Thus, here, the operation of the gas side shut-off valve including its shutoff performance can be reliably checked.

An air conditioning system according to a third aspect is the air conditioning system according to the first aspect, in which the temperature sensor includes an indoor-heat-exchanger-liquid-side temperature sensor detecting a temperature of the refrigerant on the liquid side end of the indoor heat exchanger and an indoor temperature sensor detecting a temperature of air in the indoor unit. Here, in the shut-off valve inspection process, the system control part operates the compressor in the state in which the outdoor heat exchanger functions as a radiator for the refrigerant in the state in which closing operation of the liquid side shut-off valve has been performed and opening operation of the gas side shut-off valve has been performed. In addition, after starting this operation of the compressor, the system control part determines that the liquid side shut-off valve properly operates in the case in which the temperature of the refrigerant detected by the indoor-heat-exchanger-liquid-side temperature sensor after a second predetermined time has elapsed is equal to or more than a second predetermined temperature, or, in the case in which an absolute value of a difference in temperature between the temperature of the refrigerant detected by the indoor-heat-exchanger-liquid-side temperature sensor and the temperature of the air detected by the indoor temperature sensor after the second predetermined time has elapsed is equal to or less than a second predetermined difference in temperature.

When the closing operation of the liquid side shut-off valve has been performed, the opening operation of the gas side shut-off valve has been performed, and the compressor operates in the cooling cycle state, though the temperature of the refrigerant on the liquid side end of the indoor heat exchanger drops due to the influence of the refrigerant present in the indoor heat exchanger, since the flow of the refrigerant into the indoor heat exchanger does not occur as long as the liquid side shut-off valve properly operates, the temperature of the refrigerant on the liquid side end of the indoor heat exchanger subsequently gets closer to the temperature of the air in the indoor unit.

For this reason, here, as described above, in the shut-off valve inspection process, the closing operation of the liquid side shut-off valve, the opening operation of the gas side shut-off valve, and the operation of the compressor in the cooling cycle state create the situation in which the temperature of the refrigerant on the liquid side end of the indoor heat exchanger gets closer to the temperature of the air in the indoor unit after the temperature of the refrigerant has temporarily dropped, as long as the liquid side shut-off valve properly operates. In addition, here, as described above, in the case in which the temperature of the refrigerant detected by the indoor-heat-exchanger-liquid-side temperature sensor after the second predetermined time has elapsed is equal to or more than the second predetermined temperature, it is determined that the temperature of the refrigerant on the liquid side end of the indoor heat exchanger gets closer to the temperature of the air in the indoor unit, and that the liquid side shut-off valve properly operates. Alternatively, as described above, in the case in which the absolute value of the difference in temperature between the temperature of the refrigerant detected by the indoor-heat-exchanger-liquid-side temperature sensor and the temperature of the air detected by the indoor temperature sensor after the second predetermined time has elapsed is equal to or less than the second predetermined difference in temperature, it is determined that the temperature of the refrigerant on the liquid side end of the indoor heat exchanger gets closer to the temperature of the air in the indoor unit, and that the liquid side shut-off valve properly operates.

Thus, here, the operation of the liquid side shut-off valve including its shutoff performance can be reliably checked.

An air conditioning system according to a fourth aspect is the air conditioning system according to the second aspect, in which, in the shut-off valve inspection process, the system control part performs opening operation of the gas side shut-off valve after the system control part has determined whether the gas side shut-off valve properly operates. In addition, after performing this opening operation of the gas side shut-off valve, the system control part determines that the liquid side shut-off valve properly operates in the case in which the temperature of the refrigerant detected by the indoor-heat-exchanger-liquid-side temperature sensor after a second predetermined time has elapsed is equal to or more than a second predetermined temperature, or, in the case in which an absolute value of a difference in temperature between the temperature of the refrigerant detected by the indoor-heat-exchanger-liquid-side temperature sensor and the temperature of the air detected by the indoor temperature sensor after the second predetermined time has elapsed is equal to or less than a second predetermined difference in temperature.

When the closing operation of the liquid side shut-off valve has been performed, the opening operation of the gas side shut-off valve has been performed, and the compressor operates in the cooling cycle state, though the temperature of the refrigerant on the liquid side end of the indoor heat exchanger drops due to the influence of the refrigerant present in the indoor heat exchanger, since the flow of the refrigerant into the indoor heat exchanger does not occur as long as the liquid side shut-off valve properly operates, the temperature of the refrigerant on the liquid side end of the indoor heat exchanger subsequently gets closer to the temperature of the air in the indoor unit.

For this reason, here, as described above, in the shut-off valve inspection process, the closing operation of the liquid side shut-off valve, the opening operation of the gas side shut-off valve, and the operation of the compressor in the cooling cycle state create the situation in which the temperature of the refrigerant on the liquid side end of the indoor heat exchanger gets closer to the temperature of the air in the indoor unit after the temperature of the refrigerant has temporarily dropped, as long as the liquid side shut-off valve properly operates. In addition, here, as described above, in the case in which the temperature of the refrigerant detected by the indoor-heat-exchanger-liquid-side temperature sensor after the second predetermined time has elapsed is equal to or more than the second predetermined temperature, it is determined that the temperature of the refrigerant on the liquid side end of the indoor heat exchanger gets closer to the temperature of the air in the indoor unit, and that the liquid side shut-off valve properly operates. Alternatively, as described above, in the case in which the absolute value of the difference in temperature between the temperature of the refrigerant detected by the indoor-heat-exchanger-liquid-side temperature sensor and the temperature of the air detected by the indoor temperature sensor after the second predetermined time has elapsed is equal to or less than the second predetermined difference in temperature, it is determined that the temperature of the refrigerant on the liquid side end of the indoor heat exchanger gets closer to the temperature of the air in the indoor unit, and that the liquid side shut-off valve properly operates.

Furthermore, here, as described above, in the shut-off valve inspection process, after the closing operation of the liquid side shut-off valve and the gas side shut-off valve is performed, the compressor operates in the cooling cycle state, and then it has been determined whether the gas side shut-off valve properly operates, the opening operation of the gas side shut-off valve is performed, and then it is determined whether the liquid side shut-off valve properly operates. In this way, here, performing the opening operation of the gas side shut-off valve after the determination of whether the gas side shut-off valve properly operates enables smooth shift to the determination of whether the liquid side shut-off valve properly operates.

Thus, here, the operation of the liquid side shut-off valve and the gas side shut-off valve including their shutoff performances can be reliably and smoothly checked.

An air conditioning system according to a fifth aspect is the air conditioning system according to the third or fourth aspect, in which the second predetermined temperature is obtained on the basis of the temperature of the refrigerant detected by the indoor-heat-exchanger-liquid-side temperature sensor at the start of the shut-off valve inspection process.

Here, as described above, the second predetermined temperature used for the determination of whether the liquid side shut-off valve properly operates can be suitably set.

An air conditioning system according to a sixth aspect is the air conditioning system according to the third or fourth aspect, in which the outdoor unit is provided with a suction pressure sensor detecting a pressure of the refrigerant on a suction side of the compressor. Here, the second predetermined temperature is obtained on the basis of the pressure of the refrigerant detected by the suction pressure sensor at the determination of whether the liquid side shut-off valve properly operates.

Here, as described above, the second predetermined temperature used for the determination of whether the liquid side shut-off valve properly operates can be suitably set.

An air conditioning system according to a seventh aspect is the air conditioning system according to any one of the second to sixth aspects, in which the indoor unit is provided with an indoor fan supplying the indoor heat exchanger with the air. Here, the system control part performs the shut-off valve inspection process in the state in which the system control part operates the indoor fan.

It is determined whether the shut-off valves properly operate by using as an index the relationship between the temperature of the refrigerant on the liquid side end of the indoor heat exchanger and the temperature of the air in the indoor unit in the shut-off valve inspection process, and thus, it is preferable to stabilize the temperature of the air in the indoor unit in the shut-off valve inspection process.

For this reason, here, as described above, the shut-off valve inspection process is performed in the state in which the indoor fan operates.

Thus, here, with the stabilization of the temperature of the air in the indoor unit as the index for the determination of whether the shut-off valves properly operate in the shut-off valve inspection process, the determination precision can be enhanced and a period of time for the determination can be shortened.

An air conditioning system according to an eighth aspect is the air conditioning system according to any one of the first to seventh aspects, in which the outdoor unit is provided with a bypass refrigerant pipe returning the refrigerant discharged from the compressor to the suction side of the compressor without sending the refrigerant to the indoor unit. Here, the system control part performs the shut-off valve inspection process in the state in which the refrigerant discharged from the compressor is returning to the suction side of the compressor through the bypass refrigerant pipe.

When the closing operation of the liquid side shut-off valve and the gas side shut-off valve has been performed and the compressor operates in the cooling cycle state, in the case in which the liquid side shut-off valve and the gas side shut-off valve operate in the same manner as their closing operation, the flow of the refrigerant into the indoor unit does not occur, and thus, the pressure of the refrigerant on the suction side of the compressor easily drops.

For this reason, here, as described above, the bypass refrigerant pipe returning the refrigerant discharged from the compressor to the suction side of the compressor without sending the refrigerant to the indoor unit is provided so that the shut-off valve inspection process is performed in the state in which the refrigerant discharged from the compressor is returning to the suction side of the compressor through the bypass refrigerant pipe. Therefore, an excessive drop in the pressure of the refrigerant on the suction side of the compressor can be reduced.

Thus, here, the compressor in the shut-off valve inspection process can be protected, and the operation of the liquid side shut-off valve and the gas side shut-off valve including their shutoff performances can be reliably checked.

An air conditioning system according to a ninth aspect is the air conditioning system according to any one of the first to seventh aspects, in which the indoor unit is one of a plurality of indoor units, the liquid side shut-off valve corresponds to each of the indoor units and is provided on the liquid refrigerant pipe, and the gas side shut-off valve corresponds to each of the indoor units and is provided on the gas refrigerant pipe. Here, the system control part targets one or some of the indoor units and performs the shut-off valve inspection process for the liquid side shut-off valves and the gas side shut-off valves corresponding to the targeted indoor units while performing operation in which the indoor heat exchanger functions as an evaporator for refrigerant for one or those which are not targeted for the shut-off valve inspection process of the indoor units.

In the air conditioning system having the indoor units provided with the liquid side shut-off valves and the gas side shut-off valves corresponding to the respective indoor units, when closing operation of a liquid side shut-off valve and a gas side shut-off valve has been performed and the compressor operates in the cooling cycle state, in the case in which the liquid side shut-off valve and the gas side shut-off valve operate in the same manner as their closing operation, the flow of the refrigerant into an indoor unit does not occur, and thus, the pressure of the refrigerant on the suction side of the compressor easily drops.

For this reason, here, as described above, one or some of indoor units are targeted, and the shut-off valve inspection process is performed for the liquid side shut-off valves and the gas side shut-off valves corresponding to the targeted indoor units, while the operation in which the indoor heat exchanger functions as an evaporator for refrigerant is performed for one or those which are not targeted for the shut-off valve inspection process of the indoor units. Therefore, an excessive drop in the pressure of the refrigerant on the suction side of the compressor can be reduced.

Thus, here, the compressor in the shut-off valve inspection process can be protected, and the operation of the liquid side shut-off valves and the gas side shut-off valves including their shutoff performances can be reliably checked.

An air conditioning system according to a tenth aspect is the air conditioning system according to any one of the first to ninth aspects, in which the system control part is connected to a refrigerant leakage detection device detecting presence or absence of leakage of the refrigerant. Here, the system control part has a simulation input permission part for permitting opening and closing operation of the liquid side shut-off valve and the gas side shut-off valve to be performed by simulatively inputting a signal indicating presence or absence of leakage of the refrigerant outputted from the refrigerant leakage detection device into the system control part in the shut-off valve inspection process.

As described above, in the case in which the shut-off valve inspection process is performed by simulatively inputting the signal indicating the presence or absence of the leakage of the refrigerant outputted from the refrigerant leakage detection device to perform the opening and closing operation of the liquid side shut-off valve and the gas side shut-off valve, the system control part needs to differentiate whether this signal outputted from the refrigerant leakage detection device is a signal simulatively inputted or a signal indicating the presence or absence of the actual leakage of the refrigerant. This is because, when a signal indicating the occurrence of the leakage of the refrigerant is inputted from the refrigerant leakage detection device, the system control part determines that the leakage of the refrigerant actually occurs, and performs the closing operation of the liquid side shut-off valve and the gas side shut-off valve, accordingly. Consequently, the operation needed for the shut-off valve inspection process such as the operation of the compressor in the cooling cycle state cannot be performed.

For this reason, here, as described above, the system control part is provided with a simulation input permission part for permitting the opening and closing operation of the liquid side shut-off valve and the gas side shut-off valve to be performed by simulatively inputting a signal indicating the presence or absence of the leakage of the refrigerant outputted from the refrigerant leakage detection device into the system control part in the shut-off valve inspection process. Therefore, the system control part is prevented from determining that the leakage of the refrigerant actually occurs by inputting the signal indicating the presence or absence of the leakage of the refrigerant outputted from the refrigerant leakage detection device by using the simulation input permission part to permit the shut-off valve inspection process to be performed, and thus the operation needed for the shut-off valve inspection process such as the operation of the compressor in the cooling cycle state can be performed.

Thus, here, by simulatively inputting the signal indicating the presence or absence of the leakage of the refrigerant outputted from the refrigerant leakage detection device into the system control part, the shut-off valve inspection process can be performed, and a communicative connection between the system control part and the refrigerant leakage detection device as well as the operation of the liquid side shut-off valve and the gas side shut-off valve can be checked.

DESCRIPTION OF EMBODIMENTS

Hereinafter, exemplary embodiments of an air conditioning system according to the present invention will be described with reference to the drawings. Note that specific configurations of the embodiments of the air conditioning system according to the present invention are not limited to those of these embodiments and their modifications. The specific configurations are alterable in a scope that does not depart from the gist of the invention.

<First Embodiment>

(1) Configuration

—Overall Configuration—

Figure 1:
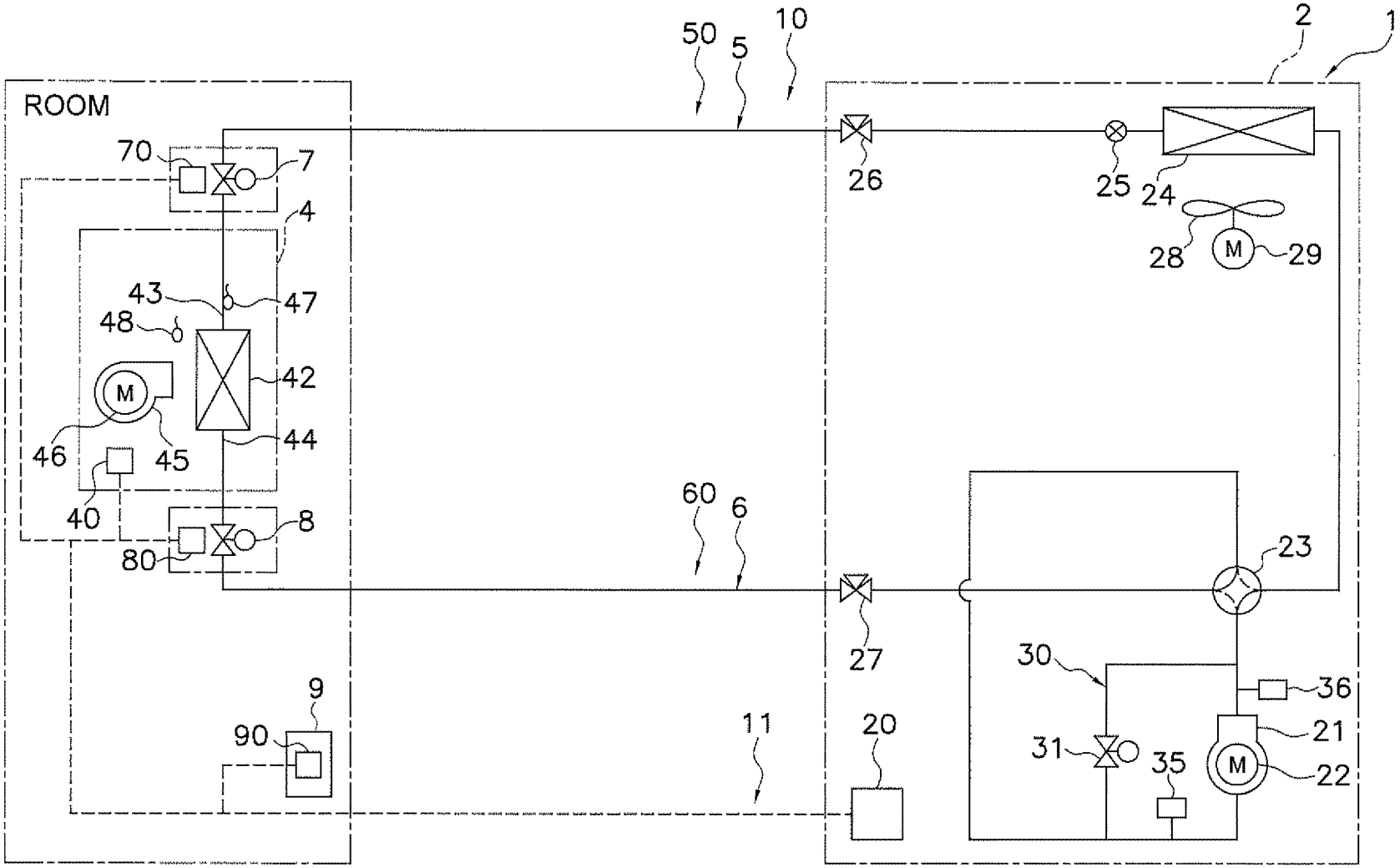
FIG. 1 is a schematic configuration diagram of an air conditioning system according to a first embodiment of the present invention.

FIG. 1 is a schematic configuration diagram of an air conditioning system 1 according to a first embodiment of the present invention.

The air conditioning system 1 is a system performing a vapor compression refrigeration cycle to cool and/or heat a room in a building and the like. The air conditioning system 1 primarily includes a vapor compression refrigerant circuit 10 configured by connecting an outdoor unit 2 to an indoor unit 4 via a liquid refrigerant communication pipe 5 and a gas refrigerant communication pipe 6. The outdoor unit 2 is installed outdoors and primarily has a compressor 21 and an outdoor heat exchanger 24. The indoor unit 4 is installed in a room and has an indoor heat exchanger 42. The refrigerant circuit 10 is filled with refrigerant which is refrigerant having mild flammability such as R32 or refrigerant having high flammability such as R290.

Moreover, the air conditioning system 1 is also provided with a liquid side shut-off valve 7 closed when leakage of the refrigerant is detected being provided on a liquid refrigerant pipe 50 including the liquid refrigerant communication pipe 5 and extending from a liquid side end of the outdoor unit 2 to a liquid side end of the indoor heat exchanger 42 and a gas side shut-off valve 8 closed when the leakage of the refrigerant is detected being provided on a gas refrigerant pipe 60 including the gas refrigerant communication pipe 6 and extending from a gas side end of the outdoor unit 2 to a gas side end of the indoor heat exchanger 42. Here, a liquid side stop valve 26 manually operated to open and close is provided on the liquid side end of the outdoor unit 2. A gas side stop valve 27 manually operated to open and close is provided on the gas side end of the outdoor unit 2. Moreover, the indoor unit 4 has an indoor liquid refrigerant pipe 43 connecting the liquid refrigerant communication pipe 5 and the liquid side end of the indoor heat exchanger 42 to each other and an indoor gas refrigerant pipe 44 connecting the gas refrigerant communication pipe 6 and the gas side end of the indoor heat exchanger 42 to each other. Thus, the liquid refrigerant pipe 50 refers to a refrigerant pipe constructed of the liquid refrigerant communication pipe 5 and the indoor liquid refrigerant pipe 43, and the gas refrigerant pipe 60 refers to a refrigerant pipe constructed of the gas refrigerant communication pipe 6 and the indoor gas refrigerant pipe 44. The liquid side shut-off valve 7 and the gas side shut-off valve 8 are valves closed when the leakage of the refrigerant is detected. Here, the liquid side shut-off valve 7 is provided on a portion of the liquid refrigerant communication pipe 5 of the liquid refrigerant pipe 50 closer to the indoor unit 4, and the gas side shut-off valve 8 is provided on a portion of the gas refrigerant communication pipe 6 of the gas refrigerant pipe 60 closer to the indoor unit 4. Moreover, unlike manual valves such as the liquid side stop valve 26 and the gas side stop valve 27, the liquid side shut-off valve 7 and the gas side shut-off valve 8 are constructed of automatic valves operated to open and close in response to a signal such as a signal indicating the presence or absence of the leakage of the refrigerant and a signal commanding to open and close from outside. Note that, here, in order to detect the presence or absence of the leakage of the refrigerant, a refrigerant leakage detection device 9 is provided in the room.

In addition, the air conditioning system 1 is provided with a system control part 11 controlling constituent devices including the liquid side shut-off valve 7 and the gas side shut-off valve 8. The system control part 11 is configured by connecting an outdoor control part 20 controlling constituent devices of the outdoor unit 2, an indoor control part 40 controlling constituent devices of the indoor unit 4, a liquid side shutoff control part 70 controlling the liquid side shut-off valve 7, and a gas side shutoff control part 80 controlling the gas side shut-off valve 8 to each other via communication lines. The outdoor control part 20 is provided in the outdoor unit 2. The indoor control part 40 is provided in the indoor unit 4. The liquid side shutoff control part 70 is provided at the liquid side shut-off valve 7. The gas side shutoff control part 80 is provided at the gas side shut-off valve 8. Moreover, the system control part 11 is also connected to a refrigerant leakage detection control part 90 controlling the refrigerant leakage detection device 9. This refrigerant leakage detection control part 90 is provided in the refrigerant leakage detection device 9. Note that, here, wired communications are employed for the control parts 20, 40, 70, 80, and 90 connected to each other via communication lines. However, communication formats of the control parts 20, 40, 70, 80, and 90 are not limited thereto, and may be other communication formats such as wireless communications.

—Outdoor Unit—

As described above, the outdoor unit 2 is connected to the indoor unit 4 via the refrigerant communication pipes 5, 6, and constitutes a portion of the refrigerant circuit 10.

The outdoor unit 2 primarily has the compressor 21, a switching mechanism 23, the outdoor heat exchanger 24, an outdoor expansion valve 25, the liquid side stop valve 26, the gas side stop valve 27, and a gas bypass pipe 30.

The compressor 21 is a mechanism compressing the refrigerant, and here, employed is a hermetic compressor in which a casing (not shown) houses positive displacement compressor elements (not shown), such as a rotary and a scroll, driven by a compressor motor 22 housed in the same casing.

The switching mechanism 23 is a four-way switching valve switchable between a cooling cycle state in which the outdoor heat exchanger 24 functions as a radiator for the refrigerant and a heating cycle state in which the outdoor heat exchanger 24 functions as a evaporator for the refrigerant. Here, the cooling cycle state is a switched state allowing a discharge side of the compressor 21 and a gas side end of the outdoor heat exchanger 24 to be in communication with each other and allowing the gas refrigerant communication pipe 6 and a suction side of the compressor 21 to be in communication with each other (see the solid curve of the switching mechanism 23 in FIG. 1). The heating cycle state is a switched state allowing the discharge side of the compressor 21 and the gas refrigerant communication pipe 6 to be in communication with each other and allowing the gas side end of the outdoor heat exchanger 24 and the suction side of the compressor 21 to be in communication with each other (see the broken curve of the switching mechanism 23 in FIG. 1). Note that the switching mechanism 23 is not limited to a four-way switching valve, and, for example, may be configured by combining or the like a plurality of solenoid valves to have the function of switching the direction of the flow of the refrigerant in the same manner as described above.

The outdoor heat exchanger 24 is a heat exchanger functioning as a radiator or an evaporator for the refrigerant by performing heat exchange between the refrigerant and outdoor air. The outdoor air exchanging heat with the refrigerant in this outdoor heat exchanger 24 is supplied by the outdoor fan 28 driven by the outdoor fan motor 29.

The outdoor expansion valve 25 is a mechanism depressurizing the refrigerant, and here, employed is an electric expansion valve with a degree of opening which is capable of being controlled.

As described above, the liquid side stop valve 26 is a valve, which is manually operated to open and close, provided on the liquid side end of the outdoor unit 2, and the gas side stop valve 27 is a valve, which is manually operated to open and close, provided on the gas side end of the outdoor unit 2.

The gas bypass pipe 30 is a bypass refrigerant pipe returning the refrigerant discharged from the compressor 21 to the suction side of the compressor 21 without sending it to the indoor unit 4. The gas bypass pipe 30 is provided with a bypass on-off valve 31, which is constructed of an automatic valve capable of being controlled to open and close, controlled to an open state in the case in which it allows the refrigerant to flow into the gas bypass pipe 30 and controlled to a closed state in the case in which it does not allow the refrigerant to flow into the gas bypass pipe 30.

Moreover, the outdoor unit 2 is provided with various sensors. Specifically, a suction pressure sensor 35 detecting a pressure Ps of the refrigerant on the suction side of the compressor 21 and a discharge pressure sensor 36 detecting a pressure Pd of the refrigerant on the discharge side of the compressor 21 are provided around the compressor 21 of the outdoor unit 2.

—Indoor Unit—

As described above, the indoor unit 4 is connected to the outdoor unit 2 via the refrigerant communication pipes 5, 6, and constitutes a portion of the refrigerant circuit 10.

The indoor unit 4 primarily has the indoor heat exchanger 42.

The indoor heat exchanger 42 is a heat exchanger functioning as an evaporator or a radiator for the refrigerant by performing heat exchange between the refrigerant and indoor air. The indoor air exchanging heat with the refrigerant in this indoor heat exchanger 42 is supplied by an indoor fan 45 driven by the indoor fan motor 46.

Moreover, the indoor unit 4 is provided with various sensors. Specifically, an indoor-heat-exchanger-liquid-side sensor 47 detecting a temperature Trl of the refrigerant on the liquid side end of the indoor heat exchanger 42 and an indoor air sensor 48 detecting a temperature Tra of the indoor air sucked in the indoor unit 4 are provided in the indoor unit 4.

—System Control Part and Refrigerant Leakage Detection Control Part—

Figure 2:
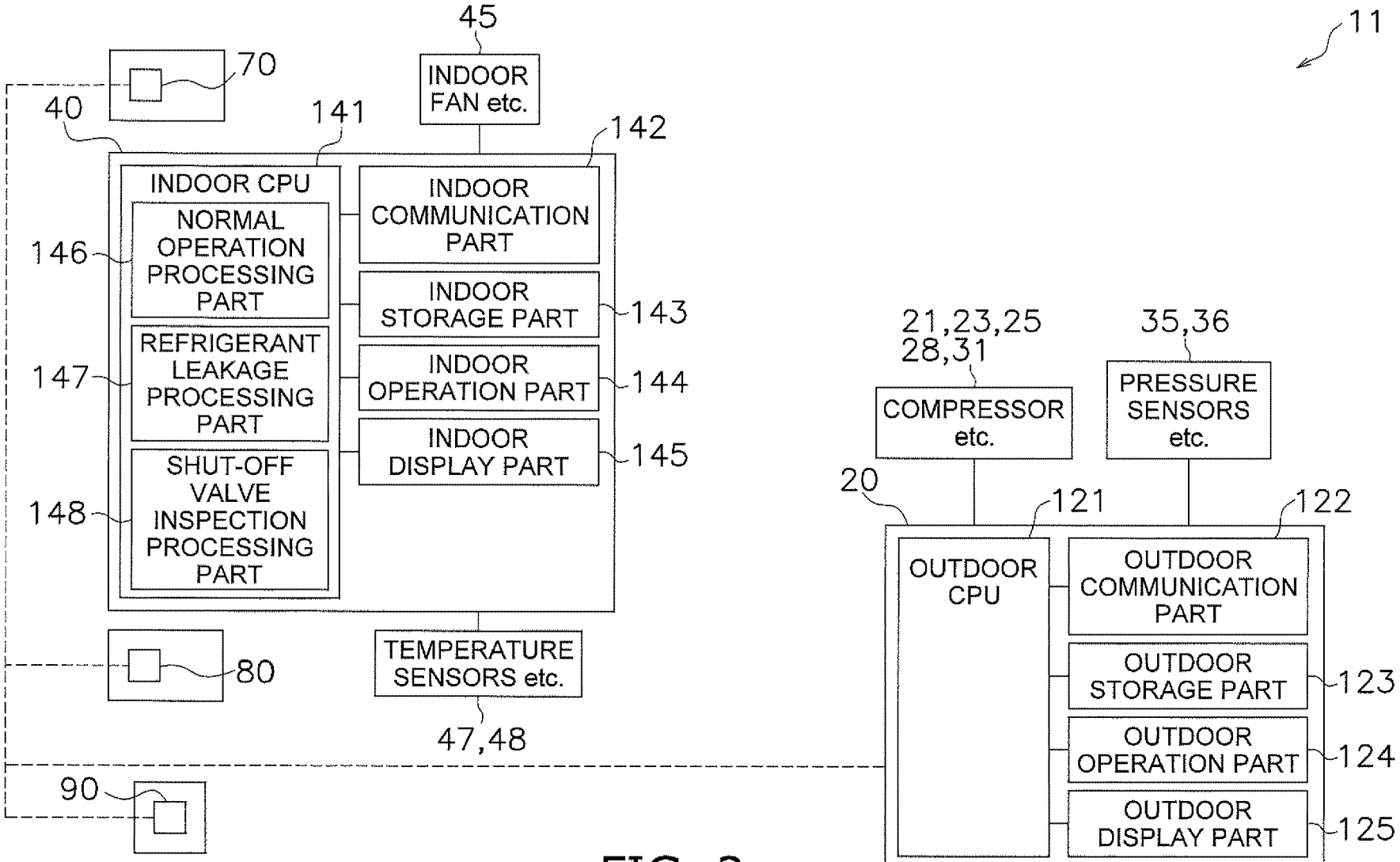
FIG. 2 is a control block diagram of the air conditioning system according to the first embodiment of the present invention (this figure shows an outdoor control part and an indoor control part in detail).
Figure 3:
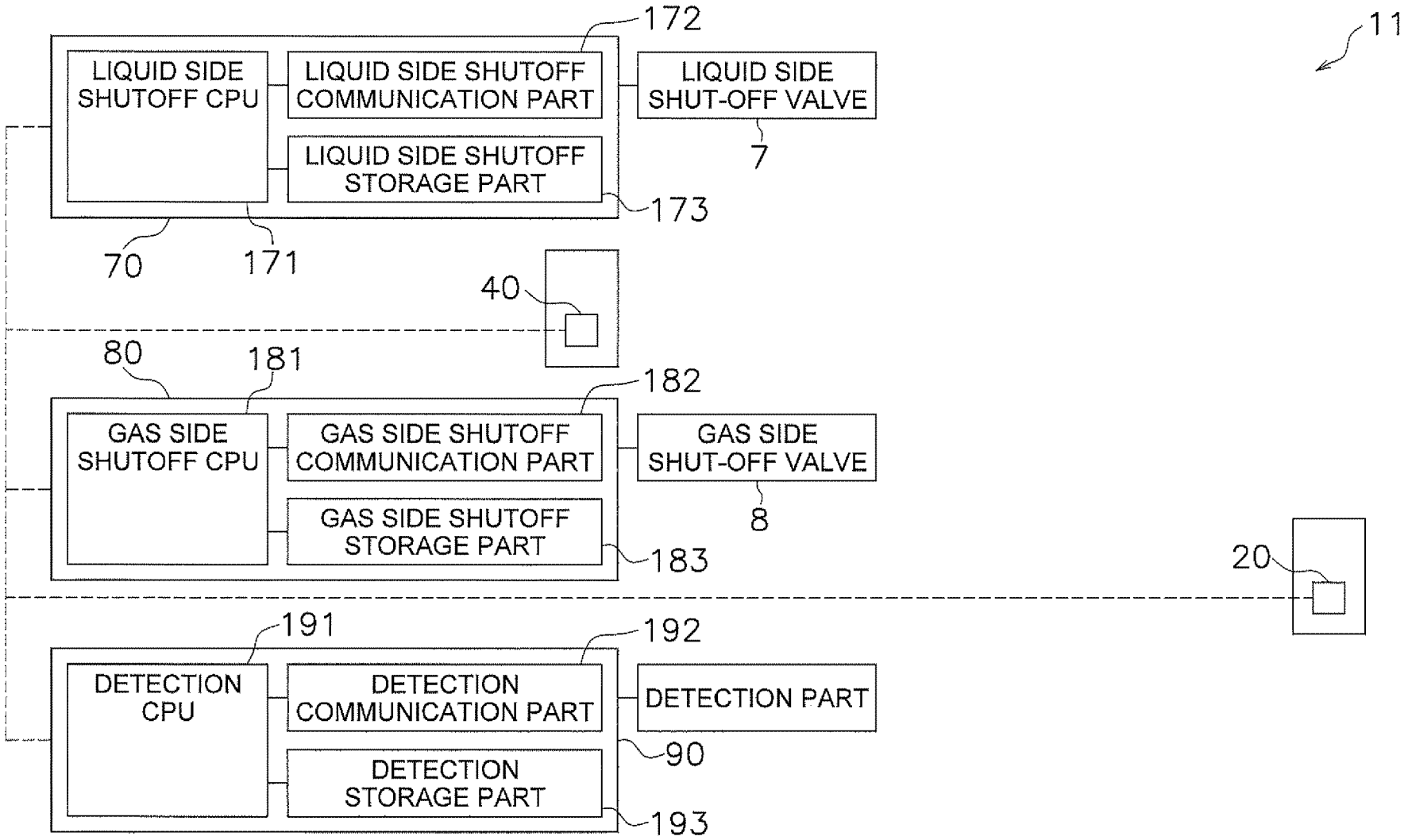
FIG. 3 is a control block diagram of the air conditioning system according to the first embodiment of the present invention (this figure shows shut-off valve control parts and a refrigerant leakage detection part in detail).

FIG. 2 is a control block diagram of the air conditioning system 1 (this figure shows the outdoor control part 20 and the indoor control part 40 in detail). FIG. 3 is a control block diagram of the air conditioning system 1 (this figure shows the shut-off valve control parts 70, 80 and the refrigerant leakage detection part 90 in detail).

The outdoor control part 20 controls the operation of the outdoor unit 2, and constitutes a portion of the system control part 11. The outdoor control part 20 primarily has an outdoor CPU 121, an outdoor communication part 122, an outdoor storage part 123, an outdoor operation part 124, and an outdoor display part 125. The outdoor CPU 121 is connected to the outdoor communication part 122, the outdoor storage part 123, the outdoor operation part 124, and the outdoor display part 125. The outdoor communication part 122 communicates control data and the like with the indoor control part 40. The outdoor storage part 123 stores control data and the like. The outdoor operation part 124 inputs control commands and the like. The outdoor display part 125 displays (outputs) an operational state and the like. In addition, the outdoor CPU 121 receives input such as control commands and the like and/or communicates control data and the like via the outdoor communication part 122 and/or the outdoor operation part 124, and reads control data and the like from and writes it to the outdoor storage part 123, displays an operational state and the like on the outdoor display part 125, detects state amounts using the various sensors 35, 36, and controls the operation of the constituent devices 21, 23, 25, 28, 31 and the like of the outdoor unit 2.

The indoor control part 40 controls the operation of the indoor unit 4, and constitutes a portion of the system control part 11. The indoor control part 40 primarily has an indoor CPU 141, an indoor communication part 142, an indoor storage part 143, an indoor operation part 144, and an indoor display part 145. The indoor CPU 141 is connected to the indoor communication part 142, the indoor storage part 143, the indoor operation part 144, and the indoor display part 145. The indoor communication part 142 communicates control data and the like with the outdoor control part 20, the liquid side shutoff control part 70, the gas side shutoff control part 80, and the refrigerant leakage detection control part 90. The indoor storage part 143 stores control data and the like. The indoor operation part 144 inputs control commands and the like. The indoor display part 145 displays (outputs) an operational state and the like. In addition, the indoor CPU 141 receives input such as control commands and the like and/or communicates control data and the like via the indoor communication part 142 and/or the indoor operation part 144, and reads control data and the like from and writes it to the indoor storage part 143, displays an operational state and the like on the indoor display part 145, detects state amounts using the various sensors 47, 48, and controls the operation of the constituent device 45 and the like of the indoor unit 4. Note that in the case in which a remote controller corresponding to the indoor unit 4 is provided, also the remote controller constitutes the indoor control part 40.

The liquid side shutoff control part 70 performs control of the opening and closing of the liquid side shut-off valve 7, and constitutes a portion of the system control part 11. The liquid side shutoff control part 70 primarily has a liquid side shutoff CPU 171, a liquid side shutoff communication part 172, and a liquid side shutoff storage part 173. The liquid side shutoff CPU 171 is connected to the liquid side shutoff communication part 172 and the liquid side shutoff storage part 173. The liquid side shutoff communication part 172 communicates control data and the like with the indoor control part 40. The liquid side shutoff storage part 173 stores control data and the like. In addition, the liquid side shutoff CPU 171 communicates control data and the like via the liquid side shutoff communication part 172, reads control data and the like from and writes it to the liquid side shutoff storage part 173, and performs the control of the opening and closing of the liquid side shut-off valve 7.

The gas side shutoff control part 80 performs control of the opening and closing of the gas side shut-off valve 8, and constitutes a portion of the system control part 11. The gas side shutoff control part 80 primarily has a gas side shutoff CPU 181, a gas side shutoff communication part 182, and a gas side shutoff storage part 183. The gas side shutoff CPU 181 is connected to the gas side shutoff communication part 182 and the gas side shutoff storage part 183. The gas side shutoff communication part 182 communicates control data and the like with the indoor control part 40. The gas side shutoff storage part 183 stores control data and the like. In addition, the gas side shutoff CPU 181 communicates control data and the like via the gas side shutoff communication part 182, reads control data and the like from and writes it to the gas side shutoff storage part 183, and performs the control of the opening and closing of the gas side shut-off valve 8.

The refrigerant leakage detection control part 90 controls detection of the refrigerant leakage detection device 9 and is connected to the system control part 11. The refrigerant leakage detection control part 90 primarily has a detection CPU 191, a detection communication part 192, and a detection storage part 193. The detection CPU 191 is connected to the detection communication part 192 and the detection storage part 193. The detection communication part 192 communicates control data and the like with the indoor control part 40. The detection storage part 193 stores control data and the like. In addition, the detection CPU 191 communicates control data and the like via the detection communication part 192, reads control data and the like from and writes it to the detection storage part 193, and controls the detection of the refrigerant leakage detection device 9.

Moreover, here, the indoor CPU 141 of the indoor control part 40 is provided with a normal operation processing part 146 for executing a process for normal operation including cooling operation and heating operation, a refrigerant leakage processing part 147 for executing a refrigerant leakage process including the closure of the shut-off valves 7, 8 performed when the leakage of the refrigerant is detected, and a shut-off valve inspection processing part 148 for executing a shut-off valve inspection process including checking the operation of the shut-off valves 7, 8 performed during a periodical inspection or the like.

(2) Operation

—Normal Operation—

The air conditioning system 1 performs, as its normal operation, the cooling operation and the heating operation.

Initially, the cooling operation will be described. When the system control part 11 is instructed to perform the cooling operation via, for instance, the indoor operation part 144 of the indoor control part 40, the normal operation processing part 146 of the indoor CPU 141 executes the cooling operation as described below.

Specifically, the switching mechanism 23 switches to the cooling cycle state (the state indicated by the solid curve of the switching mechanism 23 in FIG. 1), and the compressor 21, the outdoor fan 28, and the indoor fan 45 start up. Moreover, here, since the leakage of the refrigerant does not occur (i.e., the refrigerant leakage detection device 9 does not detect the leakage of the refrigerant), the liquid side shut-off valve 7 and the gas side shut-off valve 8 are both in open states. Then, the refrigerant discharged from the compressor 21 is sent to the outdoor heat exchanger 24 through the switching mechanism 23. The refrigerant sent to the outdoor heat exchanger 24 exchanges heat with the outdoor air supplied by the outdoor fan 28 to be cooled, thereby condensing in the outdoor heat exchanger 24 functioning as a radiator for the refrigerant. This refrigerant is sent to the outdoor expansion valve 25. The refrigerant sent to the outdoor expansion valve 25 is depressurized in the outdoor expansion valve 25, and is sent to the indoor heat exchanger 42 through the liquid side stop valve 26 and the liquid refrigerant pipe 50 (the liquid refrigerant communication pipe 5, the liquid side shut-off valve 7, and the indoor liquid refrigerant pipe 43). The refrigerant sent to the indoor heat exchanger 42 exchanges heat with the indoor air supplied from the room by the indoor fan 45 to be heated, thereby evaporating in the indoor heat exchanger 42 functioning as an evaporator for the refrigerant. This refrigerant is sucked into the compressor 21 through the gas refrigerant pipe 60 (the indoor gas refrigerant pipe 44, the gas refrigerant communication pipe 6, and the gas side shut-off valve 8), the gas side stop valve 27, and the switching mechanism 23. In the meantime, the indoor air that has been cooled in the indoor heat exchanger 42 is sent to the room, and thus the indoor cooling is performed.

Next, the heating operation will be described. When the system control part 11 is instructed to perform the heating operation via, for instance, the indoor operation part 144 of the indoor control part 40, the normal operation processing part 146 of the indoor CPU 141 executes the heating operation as described below.

Specifically, the switching mechanism 23 switches to the heating cycle state (the state indicated by the broken curve of the switching mechanism 23 in FIG. 1), and the compressor 21, the outdoor fan 28, and the indoor fan 45 start up. Moreover, here, since the leakage of the refrigerant does not occur (i.e., the refrigerant leakage detection device 9 does not detect the leakage of the refrigerant), the liquid side shut-off valve 7 and the gas side shut-off valve 8 are both in open states. Then, the refrigerant discharged from the compressor 21 is sent to the indoor heat exchanger 42 through the switching mechanism 23, the gas side stop valve 27, and the gas refrigerant pipe 60 (the gas refrigerant communication pipe 6, the gas side shut-off valve 8, and the indoor gas refrigerant pipe 44). The refrigerant sent to the indoor heat exchanger 42 exchanges heat with the indoor air supplied from the room by the indoor fan 45 to be cooled, thereby condensing in the indoor heat exchanger 42 functioning as a radiator for the refrigerant. This refrigerant is sent to the outdoor expansion valve 25 through the liquid refrigerant pipe 50 (the indoor liquid refrigerant pipe 43, the liquid refrigerant communication pipe 5, and the liquid side shut-off valve 7) and the liquid side stop valve 26. In the meantime, the indoor air that has been heated in the indoor heat exchanger 42 is sent to the room, and thus the indoor heating is performed. The refrigerant sent to the outdoor expansion valve 25 is depressurized in the outdoor expansion valve 25, and is sent to the outdoor heat exchanger 24. The refrigerant sent to the outdoor heat exchanger 24 exchanges heat with the outdoor air supplied by the outdoor fan 28 to be heated, thereby evaporating in the outdoor heat exchanger 24 functioning as an evaporator for the refrigerant. This refrigerant is sucked into the compressor 21 through the switching mechanism 23.

—Refrigerant Leakage Process—

During the above-described normal operation, in the case in which the leakage of the refrigerant is detected, in order to decrease the amount of the refrigerant leaking in the room, for example, the liquid side shut-off valve 7 and the gas side shut-off valve 8 need to close. For this reason, when a signal indicating the occurrence of the leakage of the refrigerant outputted from the refrigerant leakage detection device 9 (the refrigerant leakage detection control part 90) is inputted into the system control part 11 (the indoor control part 40), the refrigerant leakage processing part 147 of the indoor CPU 141 executes the refrigerant leakage process as described below.

Specifically, the liquid side shut-off valve 7 and the gas side shut-off valve 8 close to cease the flow of the refrigerant from the outdoor unit 2 to the indoor unit 4. Moreover, also, the compressor 21 stops. Thus, the amount of the refrigerant leaking in the room can be decreased, and, here, the refrigerant having flammability can be avoided from exceeding a combustible concentration, and thus, the occurrence of an ignition hazard in the room can be reduced.

—Shut-Off Valve Inspection Process—

The refrigerant leakage process using the above-described shut-off valves 7, 8 is an efficient approach to prevent a hazard caused by the leakage of the refrigerant. In order for this refrigerant leakage process to be reliably performed, the liquid side shut-off valve 7 and the gas side shut-off valve 8 need to actually become in closed states, and desired shutoff performances need to be ensured by their closing operation when the leakage of the refrigerant is detected. In contrast to this, it is contemplated that the operation of the liquid side shut-off valve 7 and the gas side shut-off valve 8 may be checked during a periodical inspection or the like. However, the technique, as disclosed in Patent Document 1, for checking the operation of the shut-off valves using operating noises and/or vibrations during this opening and closing operation has a problem in that the technique cannot determine whether the closed shut-off valves are actually in closed states and whether desired shutoff performances (an amount of valve leakage in a closed state etc.) are ensured when the shut-off valves have been closed, and thus, the operation of the shut-off valves including their shutoff performance cannot be checked.

For this reason, here, as the shut-off valve inspection process for checking the operation of the liquid side shut-off valve 7 and the gas side shut-off valve 8, the compressor 21 operates in the state in which the outdoor heat exchanger 24 functions as a radiator for the refrigerant, the opening and closing operation of the liquid side shut-off valve 7 and the gas side shut-off valve 8 is performed, and then it is determined whether the liquid side shut-off valve 7 and the gas side shut-off valve 8 properly operate on the basis of a temperature value detected by a temperature sensor provided in the indoor unit 4. Somewhat more in detail, in the case in which the shut-off valves 7, 8 operate in the same manner as their opening and closing operation when the opening and closing operation of the shut-off valves 7, 8 has been performed and the compressor 21 operates in the state in which the outdoor heat exchanger 24 functions as a radiator for the refrigerant (the cooling cycle state), since the refrigerant in the indoor unit 4 behaves as expected in accordance with the proper operation of the shut-off valves 7, 8, the temperature value detected by the temperature sensor provided in the indoor unit 4 varies as expected in accordance with the proper operation of the shut-off valves 7, 8. On the other hand, in the case in which the shut-off valves 7, 8 do not operate in the same manner as their opening and closing operation, since the refrigerant in the indoor unit 4 does not behave as expected, the temperature value detected by the temperature sensor provided in the indoor unit 4 does not vary as expected either. In this way, when the compressor 21 operates in the cooling cycle state and the opening and closing operation of the shut-off valves 7, 8 is performed, it can be determined whether the proper operation of the shut-off valves 7, 8 including their shutoff performances is performed on the basis of the temperature value detected by the temperature sensor provided in the indoor unit 4 at this time. Thus, the shut-off valve inspection process described herein is based on such technical concept.

Figure 4:
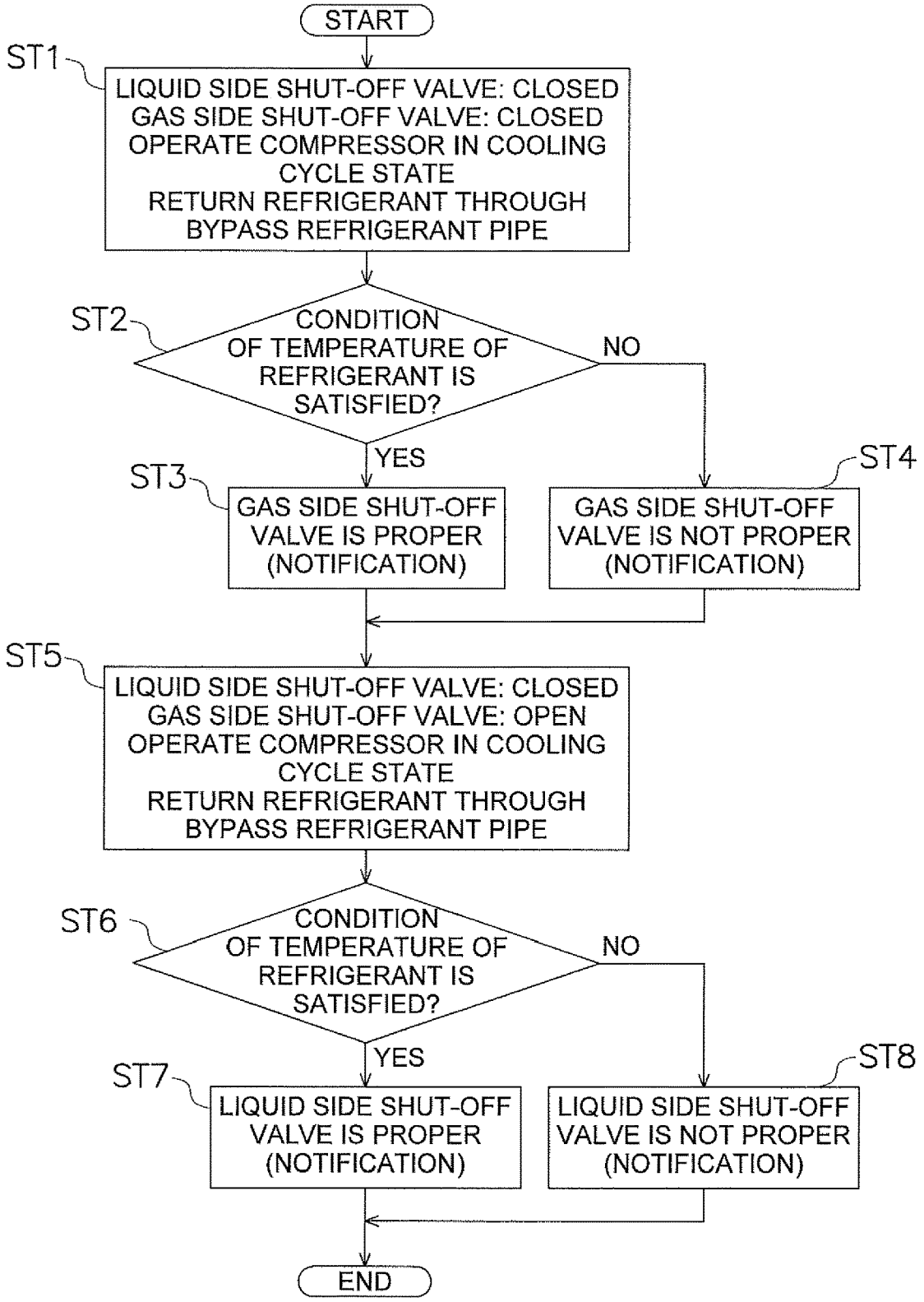
FIG. 4 is a flowchart of a shut-off valve inspection process in the air conditioning system according to the first embodiment and a second embodiment of the present invention.

Next, the shut-off valve inspection process will be described in detail with reference to FIGS. 1 to 4. Here, FIG. 4 is a flowchart of the shut-off valve inspection process. When the system control part 11 is instructed to perform the shut-off valve inspection process via, for instance, the indoor operation part 144 of the indoor control part 40 and/or the outdoor operation part 124 of the outdoor control part 20, the shut-off valve inspection processing part 148 of the indoor control part 40 executes the shut-off valve inspection process as described below.

Initially, at step ST1, in the state in which the closing operation of the liquid side shut-off valve 7 and the gas side shut-off valve 8 has been performed, the shut-off valve inspection processing part 148 operates the compressor 21 in the state in which the outdoor heat exchanger 24 functions as a radiator for the refrigerant (the cooling cycle state). That is, in the state in which the closing operation of the liquid side shut-off valve 7 and the gas side shut-off valve 8 has been performed on the indoor unit 4 side, the switching mechanism 23 switches to the cooling cycle state and the compressor 21 operates on the outdoor unit 2 side.

Here, in the case in which the flow of the refrigerant does not occur in the indoor unit 4, the refrigerant in the indoor unit 4 is in a saturated state at the same temperature as a temperature Tra of the air in the indoor unit 4. When the closing operation of the liquid side shut-off valve 7 and the gas side shut-off valve 8 has been performed from this saturated state and the compressor 21 operates in the cooling cycle state, the flow of the refrigerant does not occur in the indoor unit 4 as long as the gas side shut-off valve 8 properly operates, and thus, the temperature Trl of the refrigerant on the liquid side end of the indoor heat exchanger 42 remains at the same temperature as the temperature Tra of the air in the indoor unit 4 and does not vary. In this way, at step ST1, as described above, the closing operation of the liquid side shut-off valve 7 and the gas side shut-off valve 8 and the operation of the compressor 21 in the cooling cycle state create the situation in which the temperature Trl of the refrigerant on the liquid side end of the indoor heat exchanger 42 remains at the same temperature as the temperature Tra of the air in the indoor unit 4 and does not vary, as long as the gas side shut-off valve 8 properly operates.

Moreover, the shut-off valve inspection processing part 148 performs this closing operation of the liquid side shut-off valve 7 and this gas side shut-off valve 8 and operates the compressor 21 in the cooling cycle state in the state in which the refrigerant discharged from the compressor 21 is returning to the suction side of the compressor 21 through the gas bypass pipe 30 as a bypass refrigerant pipe. Specifically, the shut-off valve inspection processing part 148 controls the bypass on-off valve 31 to an open state to allow the refrigerant to flow into the gas bypass pipe 30.

This is because, when the closing operation of the liquid side shut-off valve 7 and the gas side shut-off valve 8 has been performed and the compressor 21 operates in the cooling cycle state, in the case in which the liquid side shut-off valve 7 and the gas side shut-off valve 8 operate in the same manner as their closing operation, the flow of the refrigerant into the indoor unit 4 does not occur, and thus, a pressure of the refrigerant on the suction side of the compressor 21 easily drops. That is, here, an excessive drop in the pressure of the refrigerant on the suction side of the compressor 21 caused by the closing operation of the liquid side shut-off valve 7 and the gas side shut-off valve 8 and the operation of the compressor 21 in the cooling cycle state.

Next, after the start of the operation at step ST1, at step ST2, in the case in which the temperature Trl of the refrigerant detected by the indoor-heat-exchanger-liquid-side temperature sensor 47 after a first predetermined time t1 has elapsed does not vary to equal to or more than the first predetermined temperature Trl1, or, in the case in which an absolute value of a difference in temperature ΔTrla between the temperature Trl of the refrigerant detected by the indoor-heat-exchanger-liquid-side temperature sensor 47 and the temperature Tra of the air detected by the indoor temperature sensor 48 after the first predetermined time t1 has elapsed is equal to or less than a first predetermined difference in temperature ΔTrla1, the shut-off valve inspection processing part 148 determines that the gas side shut-off valve 8 properly operates. That is, in the case in which the temperature Trl of the refrigerant after the first predetermined time t1 has elapsed after the start of the operation at step ST1 does not vary to equal to or more than the first predetermined temperature Trl1, it is determined that the temperature Trl of the refrigerant on the liquid side end of the indoor heat exchanger 42 remains at the same temperature as the temperature Tra of the air in the indoor unit 4 and does not vary, and that the gas side shut-off valve 8 properly operates. For example, if an absolute value of a variation value of the temperature Trl of the refrigerant after the first predetermined time t1 has elapsed after the start of the operation at step ST1 with respect to the temperature Trl of the refrigerant at the start of the operation at step ST1 is less than the first predetermined temperature Trl1, it is determined that the temperature Trl of the refrigerant remains at the same temperature as the temperature Tra of the air in the indoor unit 4 and does not vary. Alternatively, in the case in which the absolute value of the difference in temperature ΔTrla between the temperature Trl of the refrigerant and the temperature Tra of the air after the first predetermined time t1 has elapsed after the start of the operation at step ST1 is equal to or less than the first predetermined difference in temperature ΔTrla1, it is determined that the temperature Trl of the refrigerant on the liquid side end of the indoor heat exchanger 42 remains at the same temperature as the temperature Tra of the air in the indoor unit 4 and does not vary, and that the gas side shut-off valve 8 properly operates. Note that, here, though the above two determination criteria are employed, and it is determined that the gas side shut-off valve 8 properly operates if one of the two determination criteria is satisfied, the number of the employed determination criteria is not limited thereto, and only one of the two determination criteria may be employed.

Then, at step ST2, in the case in which one of the above-described conditions of the temperature Trl of the refrigerant is satisfied and it is determined that the gas side shut-off valve 8 properly operates, at step ST3, the proper operation of the gas side shut-off valve 8 is notified through a display or the like on the indoor display part 145 of the indoor control part 40. On the other hand, in the case in which the above-described conditions of the temperature Trl of the refrigerant are not satisfied and it is determined that the gas side shut-off valve 8 does not properly operate, at step ST4, the improper operation of the gas side shut-off valve 8 is notified through a display or the like on the indoor display part 145 of the indoor control part 40.

In this way, with the processes at steps ST1 to ST4, the operation of the gas side shut-off valve 8 including its shutoff performance can be reliably checked.

Next, after the shut-off valve inspection processing part 148 has determined whether the gas side shut-off valve 8 properly operates (i.e., after the processes at steps ST1 to ST4), at step ST5, it performs the opening operation of the gas side shut-off valve 8. That is, in the state in which the closing operation of the liquid side shut-off valve 7 has been performed and the opening operation of the gas side shut-off valve 8 has been performed on the indoor unit 4 side, the compressor 21 operates in the cooling cycle state on the outdoor unit 2 side.

Here, when the closing operation of the liquid side shut-off valve 7 has been performed, the opening operation of the gas side shut-off valve 8 has been performed, and the compressor 21 operates in the cooling cycle state, though the temperature Trl of the refrigerant on the liquid side end of the indoor heat exchanger 42 drops due to the influence of the refrigerant present in the indoor heat exchanger 42, since the flow of the refrigerant into the indoor heat exchanger 42 does not occur as long as the liquid side shut-off valve 7 properly operates, the temperature Trl of the refrigerant on the liquid side end of the indoor heat exchanger 42 subsequently gets closer to the temperature Tra of the air in the indoor unit 4. In this way, at step ST5, as described above, the closing operation of the liquid side shut-off valve 7, the opening operation of the gas side shut-off valve 8, and the operation of the compressor 21 in the cooling cycle state create the situation in which the temperature Trl of the refrigerant on the liquid side end of the indoor heat exchanger 42 gets closer to the temperature Tra of the air in the indoor unit 4 after the temperature Trl of the refrigerant has temporarily dropped, as long as the liquid side shut-off valve 7 properly operates.

Moreover, the shut-off valve inspection processing part 148 also performs this closing operation of the liquid side shut-off valve 7 and this opening operation of the gas side shut-off valve 8 and operates the compressor 21 in the cooling cycle state in the state in which the refrigerant discharged from the compressor 21 is returning to the suction side of the compressor 21 through the gas bypass pipe 30 as a bypass refrigerant pipe.

Next, after the opening operation of the gas side shut-off valve 8 at step ST5, at step ST6, in the case in which the temperature Trl of the refrigerant detected by the indoor-heat-exchanger-liquid-side temperature sensor 47 after a second predetermined time t2 has elapsed is equal to or more than a second predetermined temperature Trl2, or, in the case in which an absolute value of the difference in temperature ΔTrla between the temperature Trl of the refrigerant detected by the indoor-heat-exchanger-liquid-side temperature sensor 47 and the temperature Tra of the air detected by the indoor temperature sensor 48 after the second predetermined time t2 has elapsed is equal to or less than a second predetermined difference in temperature ΔTrla2, the shut-off valve inspection processing part 148 determines that the liquid side shut-off valve 7 properly operates. That is, in the case in which the temperature Trl of the refrigerant after the second predetermined time t2 has elapsed after the start of the operation at step ST5 is equal to or more than the second predetermined temperature Trl2, it is determined that the temperature Trl of the refrigerant on the liquid side end of the indoor heat exchanger 42 gets closer to the temperature Tra of the air in the indoor unit 4, and that the liquid side shut-off valve 7 properly operates. Here, the second predetermined temperature Trl2 is obtained on the basis of the temperature Trl of the refrigerant detected by the indoor-heat-exchanger-liquid-side temperature sensor 47 at the start of the shut-off valve inspection process for the liquid side shut-off valve 7 (i.e., the operation at step ST5), and is, for example, a function value of the temperature Trl of the refrigerant detected by the indoor-heat-exchanger-liquid-side temperature sensor 47 at the start of the operation at step ST5. Therefore, here, the second predetermined temperature Trl used for the determination of whether the liquid side shut-off valve 7 properly operates can be suitably set. Alternatively, in the case in which the absolute value of the difference in temperature ΔTrla between the temperature Trl of the refrigerant and the temperature Tra of the air after the second predetermined time t2 has elapsed after the start of the operation at step ST5 is equal to or less than the second predetermined difference in temperature ΔTrla2, it is determined that the temperature Trl of the refrigerant on the liquid side end of the indoor heat exchanger 42 gets closer to the temperature Tra of the air in the indoor unit 4, and that the liquid side shut-off valve 7 properly operates. Note that, here, though the above two determination criteria are employed, and it is determined that the liquid side shut-off valve 7 properly operates if one of the two determination criteria is satisfied, the number of the employed determination criteria is not limited thereto, and only one of the two determination criteria may be employed.

Then, at step ST6, in the case in which one of the above-described conditions of the temperature Trl of the refrigerant is satisfied and it is determined that the liquid side shut-off valve 7 properly operates, at step ST7, the proper operation of the liquid side shut-off valve 7 is notified through a display or the like on the indoor display part 145 of the indoor control part 40. On the other hand, in the case in which the above-described conditions of the temperature Trl of the refrigerant are not satisfied and it is determined that the liquid side shut-off valve 7 does not properly operates, at step ST8, the improper operation of the liquid side shut-off valve 7 is notified through a display or the like on the indoor display part 145 of the indoor control part 40.

In this way, with the processes at steps ST5 to ST8, the operation of the liquid side shut-off valve 7 including its shutoff performance can be reliably checked. That is, with the processes at steps ST1 to ST8, the operation of the liquid side shut-off valve 7 and the gas side shut-off valve 8 including their shutoff performances can be reliably checked.

Furthermore, here, in the shut-off valve inspection process, after the closing operation of the liquid side shut-off valve 7 and the gas side shut-off valve 8 is performed; the compressor 21 operates in the cooling cycle state; then it has been determined whether the gas side shut-off valve 8 properly operates (at steps ST1-ST4), the opening operation of the gas side shut-off valve 8 is performed, and then it is determined whether the liquid side shut-off valve 7 properly operates (at steps ST5-ST8). In this way, here, performing the opening operation of the gas side shut-off valve 8 after the determination of whether the gas side shut-off valve 8 properly operates enables smooth shift to the determination of whether the liquid side shut-off valve 7 properly operates. Therefore, here, the operation of the liquid side shut-off valve 7 and the gas side shut-off valve 8 including their shutoff performances can be reliably and smoothly checked.

Moreover, here, the shut-off valve inspection process is performed in the state in which the refrigerant discharged from the compressor 21 is returning to the suction side of the compressor 21 through the gas bypass pipe 30 as a bypass refrigerant pipe. Therefore, the compressor 21 in the shut-off valve inspection process can be protected, and the operation of the liquid side shut-off valve 7 and the gas side shut-off valve 8 including their shutoff performances can be reliably checked.

(3) Modification 1

In the above embodiment, in the shut-off valve inspection process, the second predetermined temperature Trl2 used for checking the operation of the liquid side shut-off valve 7 is obtained on the basis of the temperature Trl of the refrigerant detected by the indoor-heat-exchanger-liquid-side temperature sensor 47 at the start of the shut-off valve inspection process for the liquid side shut-off valve 7 (i.e., the operation at step ST5).

However, the second predetermined temperature Trl2 is not limited thereto, and may be obtained on the basis of the pressure Ps of the refrigerant detected by the suction pressure sensor 35 at the determination of whether the liquid side shut-off valve 7 properly operates (at the determination at step ST6). For example, the second predetermined temperature Trl2 may be a function value of the pressure Ps of the refrigerant detected by the suction pressure sensor 35 at the determination at step ST6.

Also in this case, the second predetermined temperature Trl used for the determination of whether the liquid side shut-off valve 7 properly operates can be suitably set.

(4) Modification 2

In the above embodiment and its modification 1, in the shut-off valve inspection process, when the compressor 21 operates in the cooling cycle state, the gas bypass pipe 30 as a bypass refrigerant pipe returns the refrigerant discharged from the compressor 21 to the suction side of the compressor 21 without sending it to the indoor unit 4 in order to protect the compressor 21.

Figure 5:
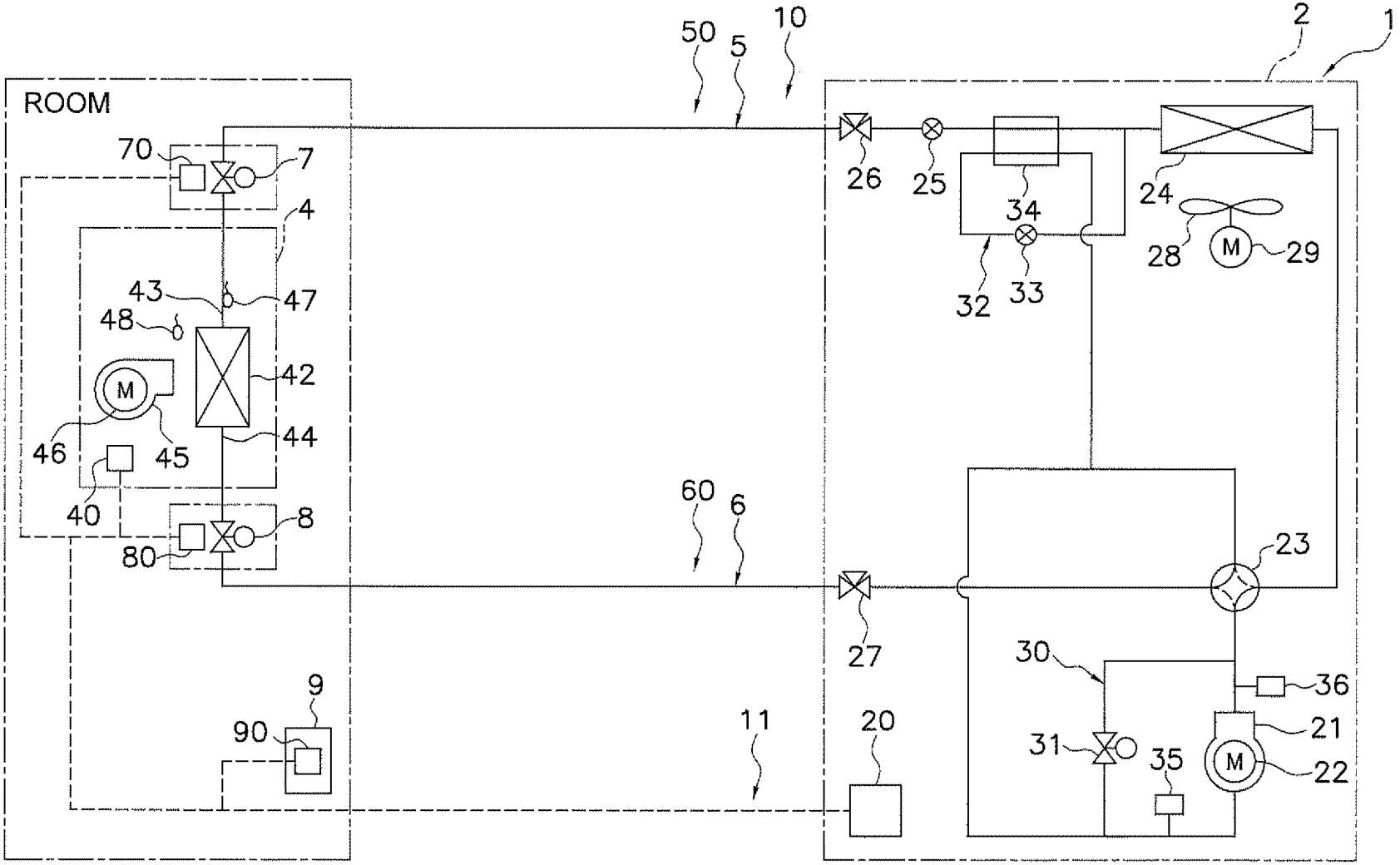
FIG. 5 is a schematic configuration diagram of the air conditioning system according to a modification 2 of the first embodiment of the present invention.

However, a bypass refrigerant pipe is not limited to the gas bypass pipe 30. For example, as shown in FIG. 5, an intake return pipe 32 may be used as a bypass refrigerant pipe in a configuration in which the refrigerant circuit 10 is provided with the intake return pipe 32 returning some of the refrigerant which has radiated heat in the outdoor heat exchanger 24 during the cooling operation to the suction side of the compressor 21 and a subcooling heat exchanger 34 further cooling the refrigerant flowing from the outdoor heat exchanger 24 to the indoor unit 4 by using the refrigerant flowing through the intake return pipe 32. That is, in the shut-off valve inspection process, the shut-off valve inspection processing part 148 operates the compressor 21 in the cooling cycle state in the state in which the refrigerant discharged from the compressor 21 is returning to the suction side of the compressor 21 through the intake return pipe 32 as a bypass refrigerant pipe. Specifically, the shut-off valve inspection processing part 148 controls an intake return expansion valve 33 provided on the intake return pipe 32 to an open state to allow the refrigerant to flow through the intake return pipe 32.

Also in this case, similarly to the above embodiment and its modification 1, the compressor 21 in the shut-off valve inspection process can be protected, and the operation of the liquid side shut-off valve 7 and the gas side shut-off valve 8 including their shutoff performances can be reliably checked.

Moreover, in the case in which both of the gas bypass pipe 30 and the intake return pipe 32 are provided (see FIG. 5), in the shut-off valve inspection process, when the compressor 21 operates in the cooling cycle state, the refrigerant discharged from the compressor 21 may return to the suction side of the compressor 21 through both of the gas bypass pipe 30 and the intake return pipe 32. In this case, since refrigerant in a high-temperature gas state returning through the gas bypass pipe 30 mixes with refrigerant in a low-temperature gas state or a gas-liquid two-phase state returning through the intake return pipe 32 on the suction side of the compressor 21, no refrigerant having a large degree of superheating and/or wetness returns to the suction side of the compressor 21 and thus, the compressor 21 can be further protected.

(5) Modification 3

In the above embodiment and its modifications 1 and 2, it is determined whether the shut-off valves 7, 8 properly operate by using as an index the relationship between the temperature Trl of the refrigerant on the liquid side end of the indoor heat exchanger 42 and the temperature Tra of the air in the indoor unit 4 in the shut-off valve inspection process, and thus, it is preferable to stabilize the temperature Tra of the air in the indoor unit 4 in the shut-off valve inspection process.

Figure 6:
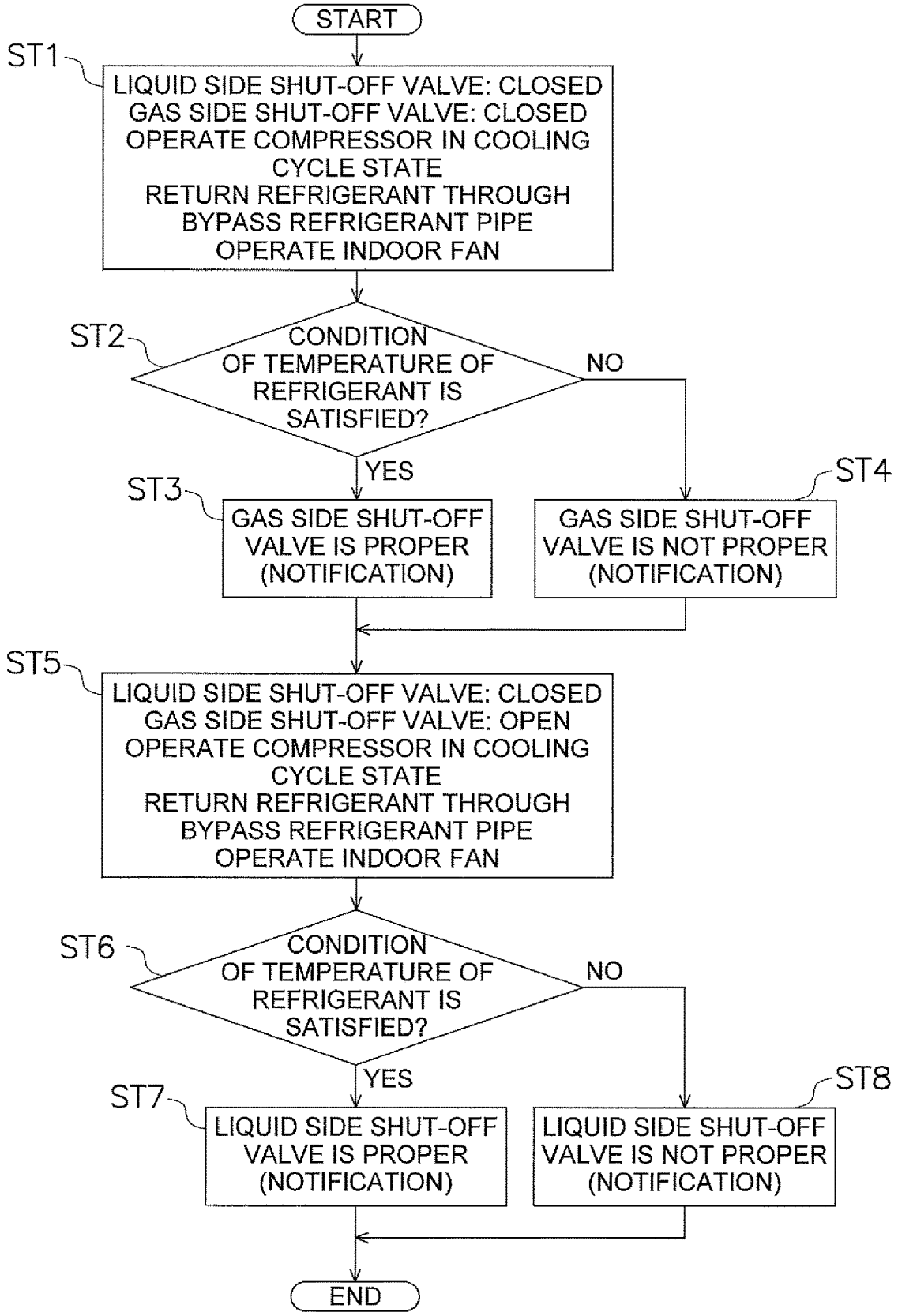
FIG. 6 is a flowchart of the shut-off valve inspection process in the air conditioning system according to modifications 3 of the first and second embodiments of the present invention.

For this reason, here, as shown in FIG. 6, the shut-off valve inspection process is performed in the state in which the indoor fan 45 operates. That is, in the shut-off valve inspection process, when the shut-off valve inspection processing part 148 operates the compressor 21 in the cooling cycle state at steps ST1 and ST5, the shut-off valve inspection processing part 148 operates the indoor fan 45.

In this case, with the stabilization of the temperature Tra of the air in the indoor unit 4 as the index for the determination of whether the shut-off valves 7, 8 properly operate in the shut-off valve inspection process, the determination precision can be enhanced, and a period of time for the determination can be shortened.

(6) Modification 4

During a periodical inspection or the like of the air conditioning system 1, in order for the refrigerant leakage process including the closure of the shut-off valves 7, 8 to be reliably performed in the case in which the leakage of the refrigerant has been detected, it is desirable to check, as well as the operation of the liquid side shut-off valve 7 and the gas side shut-off valve 8, a communicative connection between the system control part 11 and the refrigerant leakage detection device 9.

For this purpose, it is contemplated that the shut-off valve inspection process in the above embodiment and its modifications 1 to 3 may be performed by simulatively outputting a signal indicating the presence or absence of the leakage of the refrigerant from the refrigerant leakage detection device 9 and inputting this simulative signal indicating the presence or absence of the refrigerant into the system control part 11 to perform the opening and closing operation of the liquid side shut-off valve 7 and the gas side shut-off valve 8.

However, in the case in which the shut-off valve inspection process is performed by simulatively inputting the signal indicating the presence or absence of the leakage of the refrigerant outputted from the refrigerant leakage detection device 9 to perform the opening and closing operation of the liquid side shut-off valve 7 and the gas side shut-off valve 8, the system control part 11 needs to differentiate whether this signal outputted from the refrigerant leakage detection device 9 is a signal simulatively inputted or a signal indicating the presence or absence of the actual leakage of the refrigerant. This is because, when a signal indicating the occurrence of the leakage of the refrigerant is inputted from the refrigerant leakage detection device 9, the system control part 11 determines that the leakage of the refrigerant actually occurs, and performs the closing operation of the liquid side shut-off valve 7 and the gas side shut-off valve 8, accordingly. Consequently, the operation needed for the shut-off valve inspection process such as the operation of the compressor 21 in the cooling cycle state cannot be performed. That is, when a signal indicating the occurrence of the leakage of the refrigerant is inputted from the refrigerant leakage detection device 9 into the system control part 11, the refrigerant leakage processing part 147 of the system control part 11 performs the refrigerant leakage process (processes for the closing operation of the liquid side shut-off valve 7 and the gas side shut-off valve 8 and for stopping the compressor 21) whether or not this signal is simulatively input. Consequently, the shut-off valve inspection processing part 148 of the system control part 11 cannot perform the shut-off valve inspection process.

Figure 7:
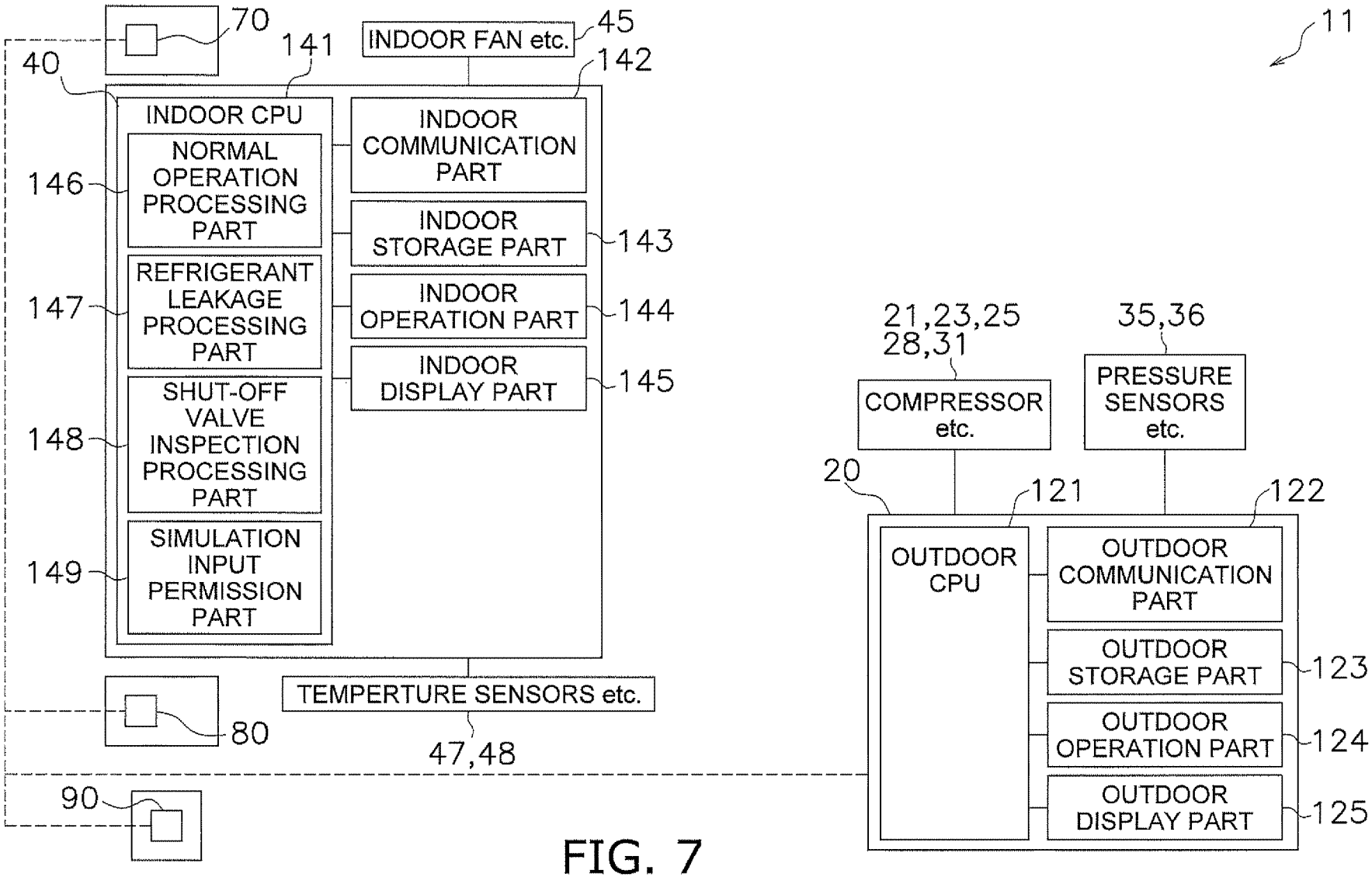
FIG. 7 is a control block diagram of the air conditioning system according to a modification 4 of the first embodiment of the present invention (this figure shows the outdoor control part and the indoor control part in detail).

For this reason, here, as shown in FIG. 7, the system control part 11 (here, the indoor CPU 141 of the indoor control part 40) is provided with a simulation input permission part 149 for permitting the opening and closing operation of the liquid side shut-off valve 7 and the gas side shut-off valve 8 to be performed by simulatively inputting a signal indicating the presence or absence of the leakage of the refrigerant outputted from the refrigerant leakage detection device 9 into the system control part 11 in the shut-off valve inspection process. In addition, before the shut-off valve inspection process is performed, by inputting into the simulation input permission part 149 through, for instance, the indoor operation part 144 of the indoor control part 40 that the opening and closing operation of the liquid side shut-off valve 7 and the gas side shut-off valve 8 is performed by the simulative input of a signal indicating the presence or absence of the leakage of the refrigerant outputted from the refrigerant leakage detection device 9, the refrigerant leakage processing part 147 is avoided from performing the refrigerant leakage process, and the shut-off valve inspection processing part 148 is permitted to perform the shut-off valve inspection process. By doing this, the system control part 11 is prevented from determining that the leakage of the refrigerant actually occurs due to the simulative input of the signal indicating the presence or absence of the leakage of the refrigerant outputted from the refrigerant leakage detection device 9, and thus the operation needed for the shut-off valve inspection process such as the operation of the compressor 21 in the cooling cycle state can be performed.

In this case, by simulatively inputting the signal indicating the presence or absence of the leakage of the refrigerant outputted from the refrigerant leakage detection device 9 into the system control part 11, the shut-off valve inspection process can be performed, and thus, the communicative connection between the system control part 11 and the refrigerant leakage detection device 9 as well as the operation of the liquid side shut-off valve 7 and the gas side shut-off valve 8 can be checked.

<Second Embodiment>

In the above first embodiment and its modifications, employed is the configuration in which one indoor unit 4 is connected to the outdoor unit 2 via the refrigerant communication pipes 5, 6, the liquid side shut-off valve 7 corresponds to this indoor unit 4 and is provided on the liquid refrigerant pipe 50, and the gas side shut-off valve 8 corresponds to this indoor unit 4 and is provided on the gas refrigerant pipe 60 (see FIGS. 1-3, 5, and 7).

However, may be employed a configuration in which a plurality of indoor units is connected to the outdoor unit 2 via the refrigerant communication pipes 5, 6, liquid side shut-off valves correspond to the respective indoor units and are provided on the liquid refrigerant pipe 50, and gas side shut-off valves correspond to the respective indoor units and are provided on the gas refrigerant pipe 60.

Figure 8:
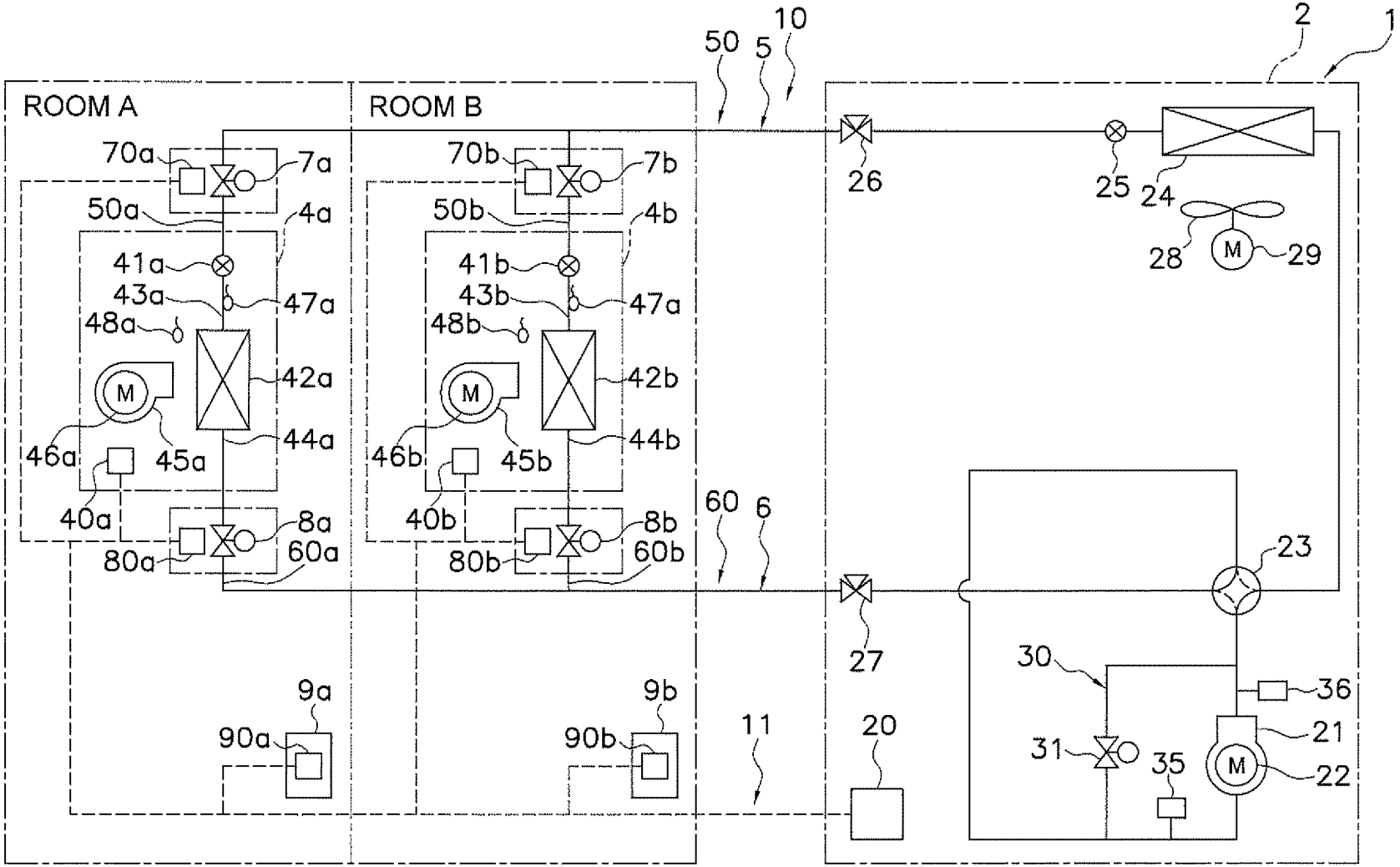
FIG. 8 is a schematic configuration diagram of the air conditioning system according to the second embodiment of the present invention.
Figure 9:
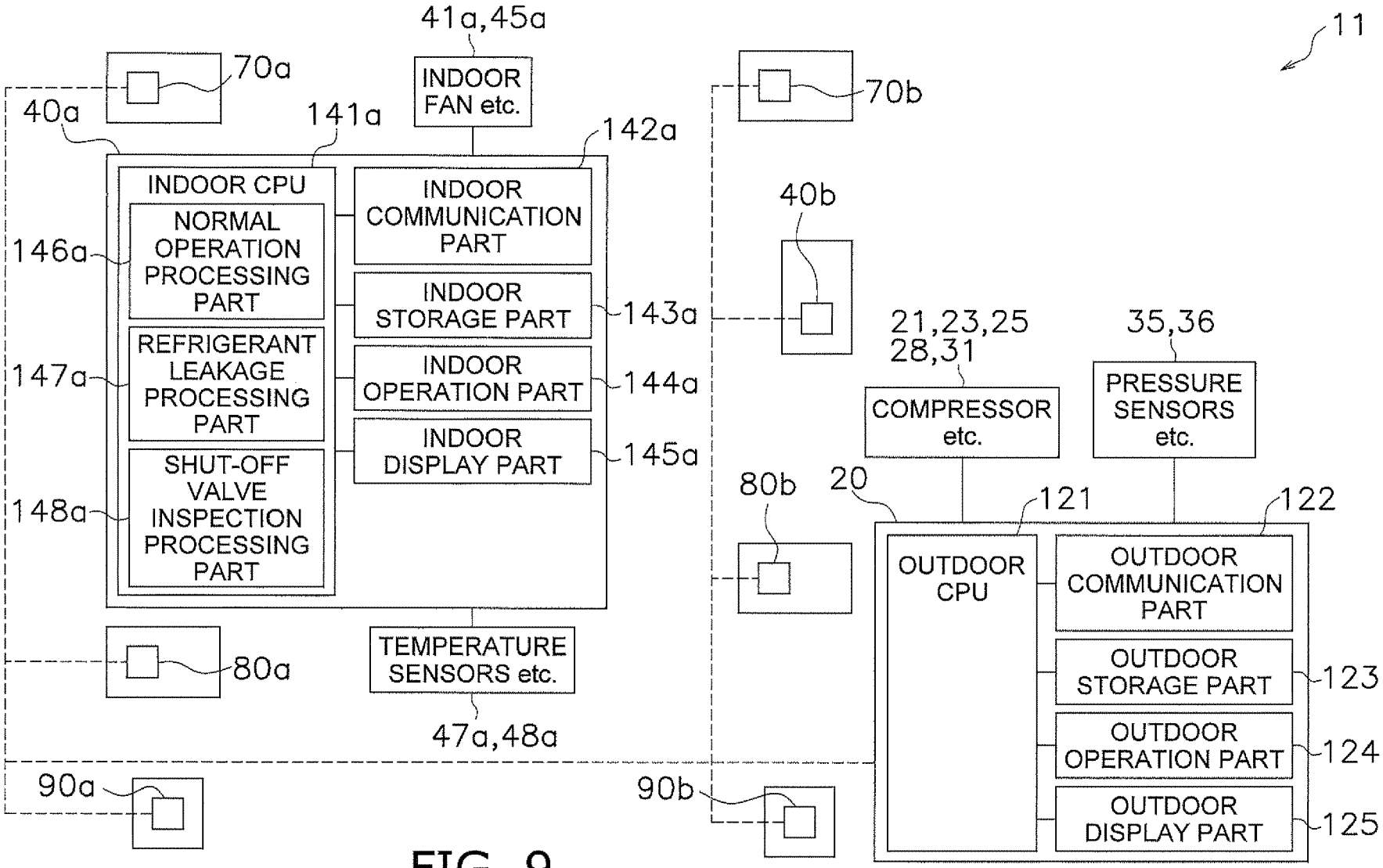
FIG. 9 is a control block diagram of the air conditioning system according to the second embodiment of the present invention (this figure shows the outdoor control part and an indoor control part in detail).
Figure 10:
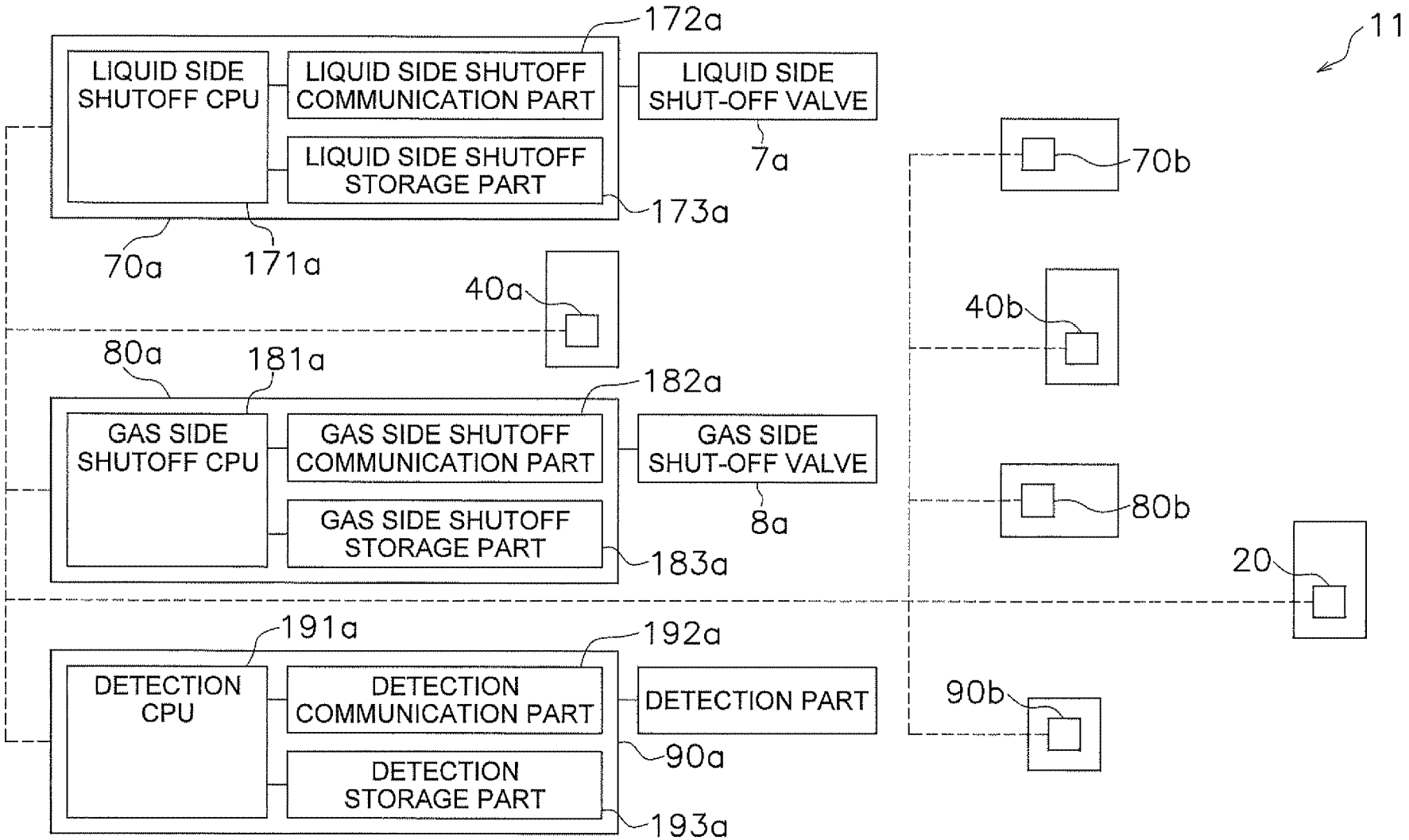
FIG. 10 is a control block diagram of the air conditioning system according to the second embodiment of the present invention (this figure shows shut-off valve control parts and refrigerant leakage detection part in detail).

As such a configuration, for example, as shown in FIGS. 8 to 10, there is a configuration in which a plurality of (here, two) indoor units 4*a*, 4*b* is connected to the outdoor unit 2 via the refrigerant communication pipes 5, 6, liquid side shut-off valves 7*a*, 7*b* correspond to the respective indoor units 4*a*, 4*b* and are provided on the liquid refrigerant pipe 50, and gas side shut-off valves 8*a*, 8*b* correspond to the respective indoor units 4*a*, 4*b* and are provided on the gas refrigerant pipe 60.

(1) Configuration

Next, mainly described will be differences between the configuration of the air conditioning system 1 having the plurality of indoor units 4*a*, 4*b* and the configuration in which one indoor unit 4 of the first embodiment is connected to the outdoor unit 2 via the refrigerant communication pipes 5, 6.

Specifically, the air conditioning system 1 having the plurality of indoor units 4*a*, 4*b* is a system performing a vapor compression refrigeration cycle to cool and/or heat rooms in a building similarly to the first embodiment. The air conditioning system 1 primarily includes the vapor compression refrigerant circuit 10 configured by connecting the outdoor unit 2 to the indoor units 4*a*, 4*b* via the liquid refrigerant communication pipe 5 and the gas refrigerant communication pipe 6. In addition, the refrigerant circuit 10 is filled with refrigerant which is refrigerant having mild flammability such as R32 or refrigerant having high flammability such as R290.

The outdoor unit 2 is installed outdoors and primarily has the compressor 21 and the outdoor heat exchanger 24, similarly to the first embodiment. Here, the outdoor unit 2 that is similar in configuration to the outdoor unit 2 of the first embodiment is denoted by the same reference numerals as used in the first embodiment and will not be described herein.

The indoor unit 4*a* is installed in a room A and has an indoor heat exchanger 42*a*. The indoor unit 4*b* is installed in a room B and has an indoor heat exchanger 42*b*. Here, the indoor units 4*a*, 4*b* that are similar in principle in configuration to the indoor unit 4 of the first embodiment are denoted by the same reference numerals as used in the first embodiment followed by a suffix letter of "a" or "b" and will not be described herein. It should be noted that, here, unlike the first embodiment, in order to enable each indoor unit 4*a*, 4*b* to individually perform cooling operation and/or heating operation, an indoor expansion valve 41*a* is provided on an indoor liquid refrigerant pipe 43*a* of the indoor unit 4*a*, and the indoor expansion valve 41*b* is provided on an indoor liquid refrigerant pipe 43*b* of the indoor unit 4*b*. These indoor expansion valves 41*a*, 41*b* are each an electric expansion valve with a degree of opening which is capable of being controlled.

Moreover, here, the liquid side shut-off valves 7*a*, 7*b* closed when the leakage of the refrigerant is detected are provided on the liquid refrigerant pipe 50 including the liquid refrigerant communication pipe 5 and extending from the liquid side end of the outdoor unit 2 to liquid side ends of the indoor heat exchangers 42*a*, 42*b*, and the gas side shut-off valves 8*a*, 8*b* closed when the leakage of the refrigerant is detected are provided on the gas refrigerant pipe 60 including the gas refrigerant communication pipe 6 and extending from the gas side end of the outdoor unit 2 to gas side ends of the indoor heat exchangers 42*a*, 42*b*. Here, the liquid side shut-off valve 7*a* is provided on a liquid refrigerant branch pipe 50*a* of the liquid refrigerant pipe 50 branching and corresponding to the indoor unit 4*a*. The liquid side shut-off valve 7*b* is provided on a liquid refrigerant branch pipe 50*b* of the liquid refrigerant pipe 50 branching and corresponding to the indoor unit 4*b*. Moreover, the gas side shut-off valve 8*a* is provided on a gas refrigerant branch pipe 60*a* of the gas refrigerant pipe 60 branching and corresponding to the indoor unit 4*a*. The gas side shut-off valve 8*b* is provided on a gas refrigerant branch pipe 60*b* of the gas refrigerant pipe 60 branching and corresponding to the indoor unit 4*b*. These shut-off valves 7*a*, 7*b*, 8*a*, 8*b* that are similar in configuration to the shut-off valves 7, 8 of the first embodiment are denoted by the same reference numerals as used in the first embodiment followed by a suffix letter of "a" or "b" and will not be described herein.

Moreover, here, in order to detect the presence or absence of the leakage of the refrigerant on the indoor unit 4*a* side, a refrigerant leakage detection device 9*a* is provided in the room A, and in order to detect the presence or absence of the leakage of the refrigerant on the indoor unit 4*b* side, a refrigerant leakage detection device 9*b* is provided in the room B. Here, the refrigerant leakage detection devices 9*a*, 9*b* that are similar in configuration to the refrigerant leakage detection device 9 of the first embodiment are denoted by the same reference numerals as used in the first embodiment followed by a suffix letter of "a" or "b" and will not be described herein.

In addition, here, provided is the system control part 11 controlling the constituent devices including the liquid side shut-off valves 7*a*, 7*b* and the gas side shut-off valves 8*a*, 8*b*. The system control part 11 is configured by connecting the outdoor control part 20 controlling the constituent devices of the outdoor unit 2, indoor control parts 40*a*, 40*b* controlling constituent devices of the indoor units 4*a*, 4*b*, liquid side shutoff control parts 70*a*, 70*b* controlling the liquid side shut-off valves 7*a*, 7*b*, and gas side shutoff control parts 80*a*, 80*b* controlling the gas side shut-off valves 8*a*, 8*b* to each other via communication lines. The outdoor control part 20 is provided in the outdoor unit 2. The indoor control parts 40*a*, 40*b* are provided in the indoor units 4*a*, 4*b*. The liquid side shutoff control parts 70*a*, 70*b* are provided at the liquid side shut-off valves 7*a*, 7*b*. The gas side shutoff control parts 80*a*, 80*b* are provided at the gas side shut-off valves 8*a*, 8*b*. Moreover, the system control part 11 is also connected to refrigerant leakage detection control parts 90*a*, 90*b* controlling the refrigerant leakage detection devices 9*a*, 9*b*. These refrigerant leakage detection control parts 90*a*, 90*b* are provided in the refrigerant leakage detection devices 9*a*, 9*b*. Here, the outdoor control part 20 that is similar to the outdoor control part 20 of the first embodiment is denoted by the same reference numeral as used in the first embodiment and will not be described herein. Moreover, the control parts 40a, 40b, 70a, 70b, 80a, 80b, 90a, 90b that are similar to the control parts 40, 70, 80, 90 of the first embodiment are denoted by the same reference numerals as used in the first embodiment followed by a suffix letter of "a" or "b" and will not be described herein.

(2) Operation

—Normal Operation—

Here, similarly to the first embodiment, as normal operation, the cooling operation and the heating operation are performed. Specifically, when the system control part 11 is instructed to perform the cooling operation and/or the heating operation via, for instance, indoor operation parts 144a, 144b of the indoor control parts 40a, 40b, normal operation processing parts 146a, 146b of indoor CPUs 141a, 141b execute the cooling operation and/or the heating operation in principle similar to the first embodiment. It should be noted that, the cooling operation and the heating operation in this embodiment are different from those in the first embodiment only in that the indoor units 4a, 4b are provided with the indoor expansion valves 41a, 41b and that their degrees of opening are controlled during the above cooling operation and/or the heating operation.

—Refrigerant Leakage Process—

During the above-described normal operation, in the case in which the leakage of the refrigerant is detected, in order to decrease the amount of refrigerant leaking in a room or the rooms, the liquid side shut-off valves 7a, 7b and the gas side shut-off valves 8a, 8b need to close. For this reason, when a signal indicating the occurrence of the leakage of the refrigerant outputted from the refrigerant leakage detection devices 9a, 9b (the refrigerant leakage detection control parts 90a, 90b) is inputted into the system control part 11 (the indoor control parts 40a, 40b), refrigerant leakage processing parts 147a, 147b of the indoor CPUs 141a, 141b execute the refrigerant leakage process similar to that of the first embodiment.

Specifically, the liquid side shut-off valves 7a, 7b and the gas side shut-off valves 8a, 8b close to cease the flow of the refrigerant from the outdoor unit 2 to the indoor units 4a, 4b. Moreover, also, the compressor 21 stops. Thus, the amount of the refrigerant leaking in the rooms A, B can be decreased, and, here, the refrigerant having flammability can be avoided from exceeding a combustible concentration, and thus, the occurrence of an ignition hazard in the room can be reduced.

—Shut-Off Valve Inspection Process—

Here, similarly to the first embodiment, as the shut-off valve inspection process for checking the operation of the liquid side shut-off valves 7a, 7b and the gas side shut-off valves 8a, 8b, the compressor 21 operates in the state in which the outdoor heat exchanger 24 functions as a radiator for the refrigerant, the opening and closing operation of the liquid side shut-off valves 7a, 7b and the gas side shut-off valves 8a, 8b is performed, and then it is determined whether the liquid side shut-off valves 7a, 7b and the gas side shut-off valves 8a, 8b properly operate on the basis of temperature values detected by temperature sensors provided in the respective indoor units 4a, 4b.

Specifically, here, similarly to the first embodiment, the shut-off valve inspection process is executed according to the processes at steps ST1 to ST8 of the flowchart as shown in FIG. 4. It should be noted that, here, since the indoor units 4a, 4b are provided with the indoor expansion valves 41a, 41b, the indoor expansion valves 41a, 41b are in open states when the closing operation of the liquid side shut-off valves 7a, 7b and the opening operation of the gas side shut-off valves 8a, 8b are performed at step ST5. Moreover, it is preferable that the indoor expansion valves 41a, 41b are in closed states when the closing operation of the liquid side shut-off valves 7a, 7b and the gas side shut-off valves 8a, 8b is performed at step ST1. That is, the indoor expansion valves 41a, 41b are in closed states in the processes at steps ST1 to ST4, and the indoor expansion valves 41a, 41b are operated to open in the processes at steps ST5 to ST8. Thus, also in this case, similarly to the first embodiment, the operation of the liquid side shut-off valves 7a, 7b and the gas side shut-off valves 8a, 8b provided to correspond to the respective indoor units 4a, 4b including their shutoff performances can be reliably checked.

Moreover, at this time, the shut-off valve inspection process, by performing the processes at steps ST1 to ST8 for each indoor unit 4a, 4b, can sequentially checks the operation of the liquid side shut-off valve 7a and the gas side shut-off valve 8a corresponding to the indoor unit 4a and the operation of the liquid side shut-off valve 7b and the gas side shut-off valve 8b corresponding to the indoor unit 4b. However, the shut-off valve inspection process employed herein is performed on the basis of the temperature values detected by the temperature sensors provided in the respective indoor units 4a, 4b, and thus, in view of this, the operation of the liquid side shut-off valves 7a, 7b and the gas side shut-off valves 8a, 8b corresponding to the indoor units 4a, 4b can be concurrently checked by simultaneously executing the processes at steps ST1 to ST8 for the plurality of indoor units 4a, 4b.

(3) Modification 1

Also in the above embodiment, similarly to the modification 1 of the first embodiment, the second predetermined temperature Trl2 used for the determination of whether the liquid side shut-off valves 7a, 7b properly operate may be obtained on the basis of the pressure Ps of the refrigerant detected by the suction pressure sensor 35 at the determination of whether the liquid side shut-off valves 7a, 7b properly operate (at the determination at step ST6).

(4) Modification 2

Figure 11:
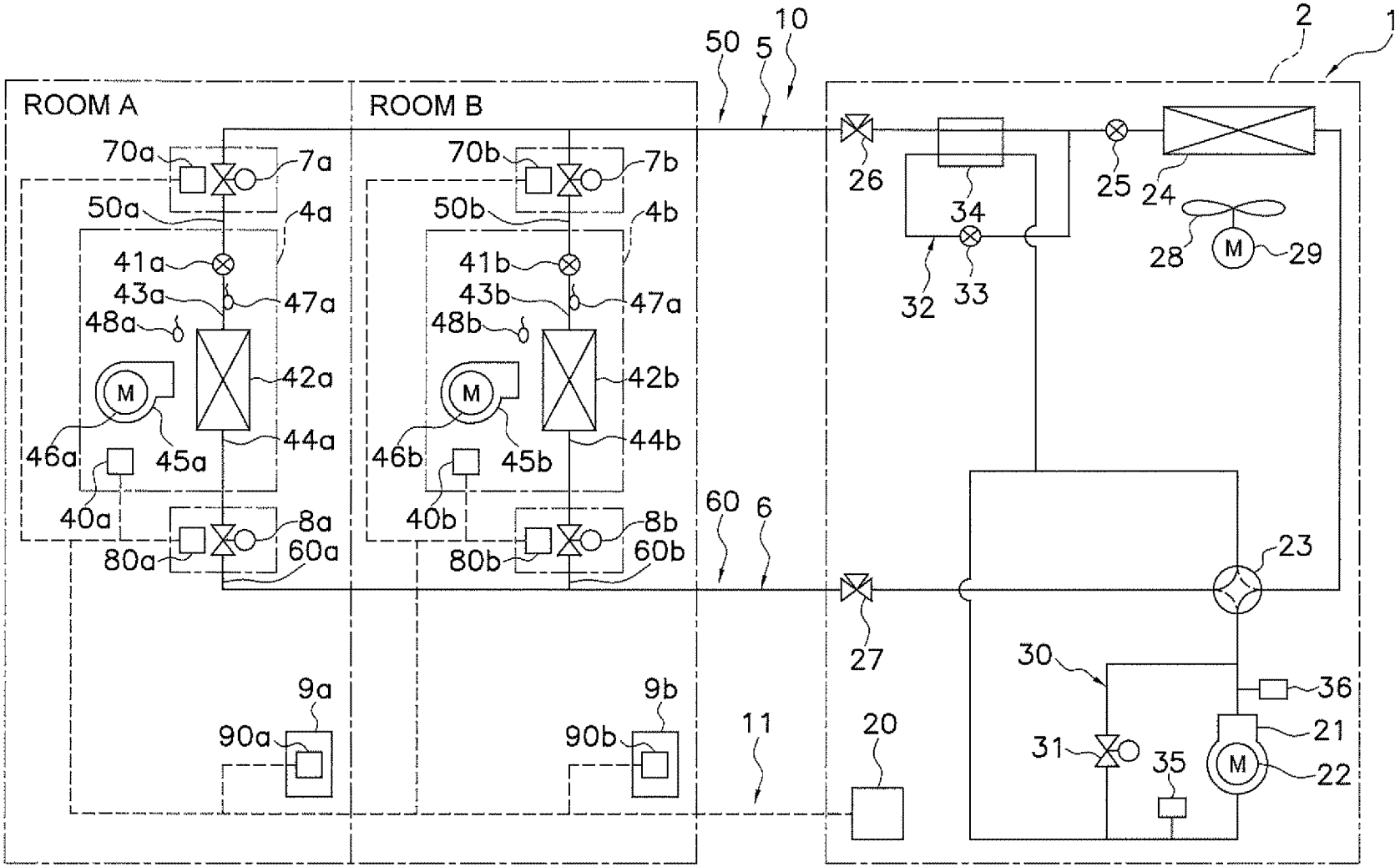
FIG. 11 is a schematic configuration diagram of the air conditioning system according to a modification 2 of the second embodiment of the present invention.

Also in the above embodiment and its modification 1, similarly to the modification 2 of the first embodiment, as shown in FIG. 11 for example, the intake return pipe 32 may be used as a bypass refrigerant pipe in a configuration in which the refrigerant circuit 10 is provided with the intake return pipe 32 and the subcooling heat exchanger 34.

(5) Modification 3

Also in the above embodiment and its modifications 1 and 2, similarly to the modification 3 of the first embodiment, as shown in FIG. 6, the shut-off valve inspection process may be performed in the state in which indoor fans 45a, 45b operate.

(6) Modification 4

Figure 12:
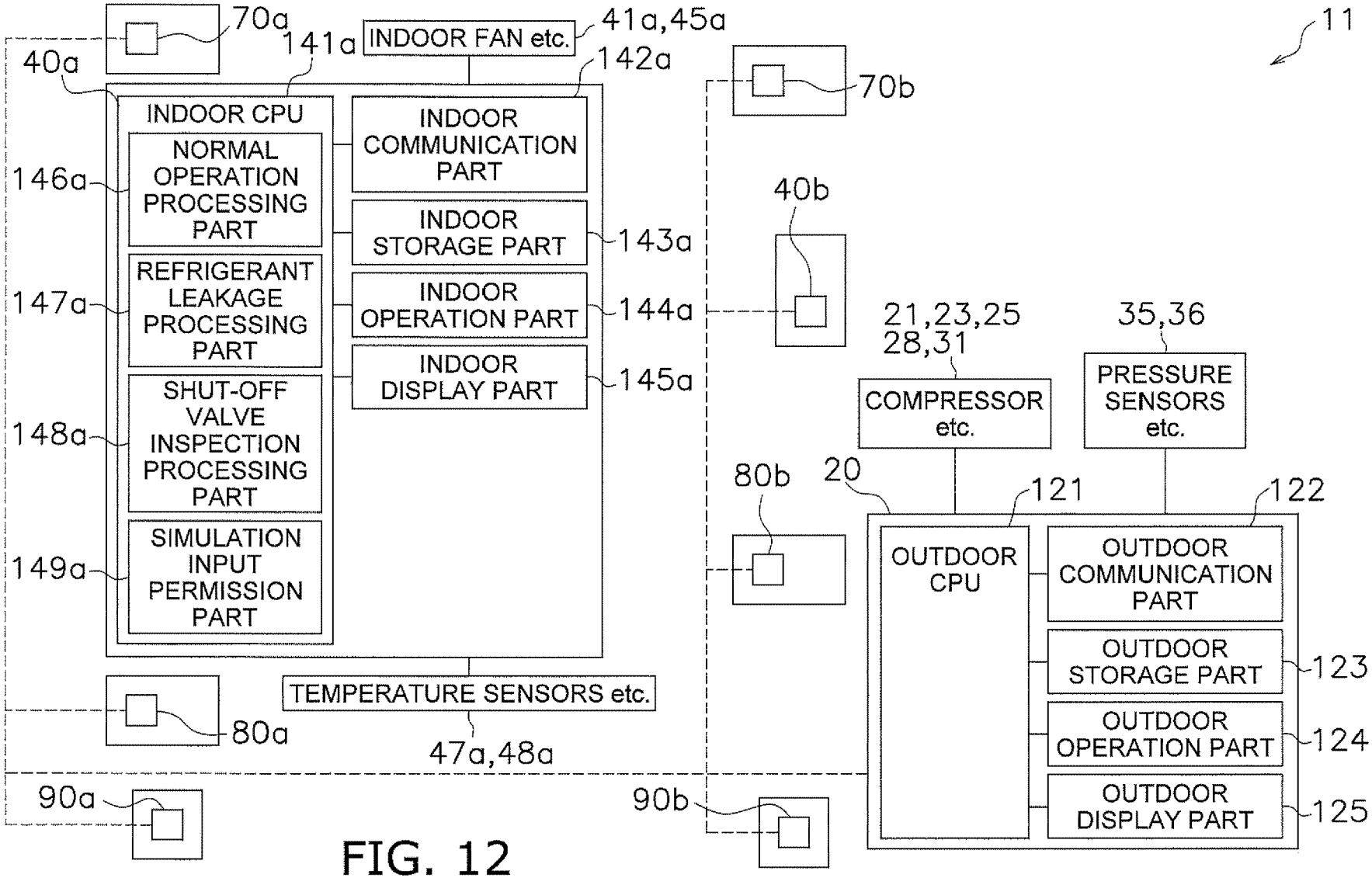
FIG. 12 is a control block diagram of the air conditioning system according to a modification 4 of the second embodiment of the present invention (this figure shows the outdoor control part and the indoor control part in detail).

Also in the above embodiment and its modifications 1 to 3, similarly to the modification 4 of the first embodiment, as shown in FIG. 12, the system control part 11 (here, the indoor CPUs 141a, 141b of the indoor control parts 40a, 40b) may be provided with simulation input permission parts 149a, 149b for permitting the opening and closing operation of the liquid side shut-off valves 7a, 7b and the gas side shut-off valves 8a, 8b to be performed by simulatively inputting a signal indicating the presence or absence of the leakage of the refrigerant outputted from the refrigerant leakage detection devices 9a, 9b into the system control part 11.

(7) Modification 5

In the above embodiment and its modifications 1-4, at steps ST1 and ST5 in the shut-off valve inspection process (see FIGS. 4 and 6), in order to reduce the drop in the pressure of the refrigerant on the suction side of the compressor 21, the compressor 21 operates in the cooling cycle state in the state in which the refrigerant discharged from the compressor 21 is returning to the suction side of the compressor 21 through the gas bypass pipe 30 and/or the intake return pipe 32 as bypass refrigerant pipes.

However, some air conditioning systems 1 do not have a configuration with such bypass refrigerant pipes, and thus, it is not preferable to provide a bypass refrigerant pipe only in order to reduce the drop in the pressure of the refrigerant on the suction side of the compressor 21 in the shut-off valve inspection process.

Figure 13:
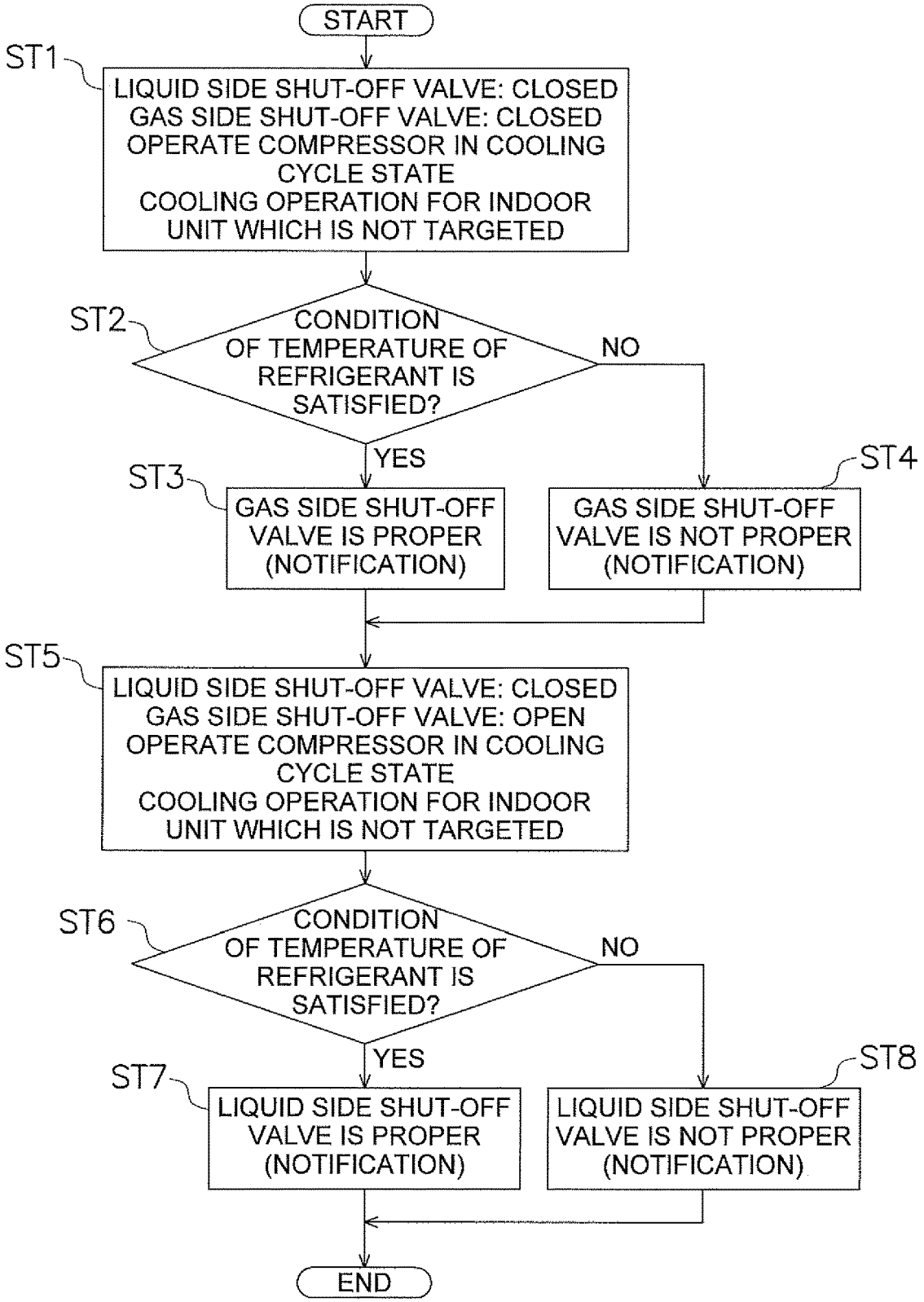
FIG. 13 is a flowchart of the shut-off valve inspection process in the air conditioning system according to a modification 5 of the second embodiment of the present invention.

For this reason, by using the fact that the plurality of (here, two) indoor units 4*a*, 4*b* is present, the system control part 11 targets one or some (e.g., the indoor unit 4*a*) of the indoor units 4*a*, 4*b* and performs the processes at steps ST1 to ST8 in the shut-off valve inspection process for the liquid side shut-off valve 7*a* and the gas side shut-off valve 8*a* corresponding to the targeted indoor unit 4*a*. In addition, as shown in FIG. 13, at steps ST1 and ST5, the system control part 11 performs operation in which the indoor heat exchanger 42*b* functions as a evaporator for the refrigerant, that is, the cooling operation for one or those (e.g., the indoor unit 4*b*) which are not targeted for the shut-off valve inspection process of the indoor units. That is, in the indoor unit 4*b* which is not targeted for the shut-off valve inspection process, the indoor expansion valve 41*b* is in an open state and the corresponding liquid side shut-off valve 7*b* and gas side shut-off valve 8*b* are in open states so that the refrigerant flows. Note that, the operation of the liquid side shut-off valve 7*b* and the gas side shut-off valve 8*b* corresponding to the indoor unit 4*b* can be checked by performing the shut-off valve inspection process similar to the above process when the indoor unit 4*b* is targeted for the shut-off valve inspection process while the indoor unit 4*a* is not targeted for the shut-off valve inspection process.

In this case, since the refrigerant discharged from the compressor 21 returns to the suction side of the compressor 21 through the indoor unit 4*b*; thus, an excessive drop in the pressure of the refrigerant on the suction side of the compressor 21 can be reduced, the compressor 21 in the shut-off valve inspection process can be protected, and the operation of the liquid side shut-off valves 7*a*, 7*b* and the gas side shut-off valves 8*a*, 8*b* including their shutoff performances can be reliably checked.

(8) Modification 6

In the above embodiment and its modifications 1-5, the liquid side shut-off valves 7*a*, 7*b* corresponding to the respective indoor units 4*a*, 4*b* are provided on the liquid refrigerant pipe 50 (50*a*, 50*b*). However, here, since the indoor expansion valves 41*a*, 41*b* corresponding to the respective indoor units 4*a*, 4*b* are provided on the liquid refrigerant pipe 50 (50*a*, 50*b*), the indoor expansion valves 41*a*, 41*b* may double as the liquid side shut-off valves 7*a*, 7*b* in the case in which shutoff performances (an amount of valve leakage in a closed state etc.) of the indoor expansion valves 41*a*, 41*b* in closed states satisfy shutoff performances needed for shut-off valves.

<Other Embodiments>

In the above the first and second embodiments and/or their modifications, employed are the configurations capable of switching between the cooling operation and the heating operation and performing them. However, configurations are not limited thereto. For example, other configurations such as a configuration without the switching mechanism 23 and dedicated for cooling may be employed.

Moreover, in the above the first and second embodiments and/or their modifications, the indoor-heat-exchanger-liquid-side temperature sensors 47, 47*a*, 47*b* are used as the temperature sensors detecting the temperature Trl of the refrigerant on the liquid side end of the indoor heat exchanger 42, 42*a*, 42*b*. However, sensors detecting the temperature Trl are not limited thereto. For example, temperature sensors detecting a temperature of the refrigerant at an intermediate portion of the indoor heat exchangers 42, 42*a*, 42*b* may be used as temperature sensors detecting the temperature Trl of the refrigerant on the liquid side end of the indoor heat exchanger 42, 42*a*, 42*b*.

Moreover, in the above the first and second embodiments and/or their modifications, the refrigerant leakage detection devices 9, 9*a*, 9*b* are provided in rooms. However, the locations of these devices are not limited thereto. For example, they may be provided in other locations, for instance, the indoor units 4, 4*a*, 4*b*.

Moreover, in the above the first and second embodiments and/or their modifications, at steps ST1-ST4, the operation of the gas side shut-off valves 8, 8*a*, 8*b* is checked, and subsequently, at steps ST5-ST8, the operation of the liquid side shut-off valves 7, 7*a*, 7*b* is checked. However, the sequence of the checking of the operation thereof are not limited thereto. For example, steps ST1-ST4 and steps ST5-ST8 may be interchanged so that the operation of liquid side shut-off valves 7, 7*a*, 7*b* may be checked, and subsequently, the operation of the gas side shut-off valves 8, 8*a*, 8*b* may be checked.

INDUSTRIAL APPLICABILITY

The present invention is widely applicable to an air conditioning system which includes a refrigerant circuit configured by connecting an outdoor unit having a compressor and an outdoor heat exchanger to an indoor unit having an indoor heat exchanger via refrigerant communication pipes and which is provided with a shut-off valve closed when leakage of refrigerant is detected being provided on a liquid refrigerant pipe extending from a liquid side end of the outdoor unit to a liquid side end of the indoor heat exchanger and a shut-off valve closed when leakage of refrigerant is detected being provided on a gas refrigerant pipe extending from a gas side end of the outdoor unit to a gas side end of the indoor heat exchanger.

REFERENCE SIGNS LIST

1 Air Conditioning System
2 Outdoor Unit
4, 4*a*, 4*b* Indoor Unit
5 Liquid Refrigerant Communication Pipe
6 Gas Refrigerant Communication Pipe
7, 7*a*, 7*b* Liquid Side Shut-Off Valve
8, 8*a*, 8*b* Gas Side Shut-Off Valve
9, 9*a*, 9*b* Refrigerant Leakage Detection Device
10 Refrigerant Circuit
11 System Control Part
21 Compressor
24 Outdoor Heat Exchanger
30 Gas Bypass Pipe
32 Intake Return Pipe
35 Suction Pressure Sensor
42, 42*a*, 42*b* Indoor Heat Exchanger
45, 45*a*, 45*b* Indoor Fan
47, 47*a*, 47*b* Indoor-Heat-Exchanger-Liquid-Side Temperature Sensor

48, 48*a*, 48*b* Indoor Temperature Sensor
50 Liquid Refrigerant Pipe
60 Gas Refrigerant Pipe
149, 149*a*, 149*b* Simulation Input Permission Part

CITATION LIST

Patent Document

PATENT DOCUMENT 1: JP-A-2013-19621

The invention claimed is:

1. An air conditioning system comprising:

a refrigerant circuit configured by connecting an outdoor unit having a compressor and an outdoor heat exchanger to an indoor unit having an indoor heat exchanger via a liquid refrigerant communication pipe and a gas refrigerant communication pipe, the indoor unit further having a liquid side shut-off valve closed when leakage of refrigerant is detected positioned on a liquid refrigerant pipe including the liquid refrigerant communication pipe and extending from a liquid side end of the outdoor unit to a liquid side end of the indoor heat exchanger, and a gas side shut-off valve closed when leakage of refrigerant is detected positioned on a gas refrigerant pipe including the gas refrigerant communication pipe and extending from a gas side end of the outdoor unit to a gas side end of the indoor heat exchanger, and a control processor configured to control the liquid side shut-off valve and the gas side shut-off valve, the control processor configured to perform a first shut-off valve inspection process for checking operation of the gas side shut-off valve by closing the gas side shut-off valve, operating the compressor in a state in which the outdoor heat exchanger functions as a radiator for the refrigerant, and determining whether the gas side shut-off valve is in a closed state individually based on first temperature value detected by a temperature sensor provided in the indoor unit, and the control processor configured to perform a second shut-off valve inspection process for checking operation of the liquid side shut-off valve by, closing the liquid side shut-off valve, operating the compressor in a state in which the outdoor heat exchanger functions as a radiator for the refrigerant, and determining whether the liquid side shut-off valve is in a closed state based on a second temperature value detected by the temperature sensor provided in the indoor unit.

2. The air conditioning system according to claim 1, wherein the temperature sensor includes an indoor-heat-exchanger-liquid-side temperature sensor detecting a temperature of the refrigerant on the liquid side end of the indoor heat exchanger and an indoor temperature sensor detecting a temperature of air in the indoor unit, and wherein, in the shut-off valve inspection process, the control processor operates the compressor in the state in which the outdoor heat exchanger functions as a radiator for the refrigerant in a state in which closing operation of the liquid side shut-off valve and the gas side shut-off valve has been performed, and determines whether the gas side shut-off valve is in a closed state in the case in which the temperature of the refrigerant, detected by the indoor-heat-exchanger-liquid-side temperature sensor after a first predetermined time has elapsed, has not varied to a value equal to or more than a first predetermined temperature, or, in a case in which an absolute value of a difference in temperature between the temperature of the refrigerant detected by the indoor-heat-exchanger-liquid-side temperature sensor and the temperature of the air detected by the indoor temperature sensor after the first predetermined time has elapsed is equal to or less than a first predetermined difference in temperature.

3. The air conditioning system according to claim 1, wherein the temperature sensor includes an indoor-heat-exchanger-liquid-side temperature sensor detecting a temperature of the refrigerant on the liquid side end of the indoor heat exchanger and an indoor temperature sensor detecting a temperature of air in the indoor unit, and wherein, in the shut-off valve inspection process, the control processor operates the compressor in the state in which the outdoor heat exchanger functions as a radiator for the refrigerant in a state in which closing operation of the liquid side shut-off valve has been performed and opening operation of the gas side shut-off valve has been performed, and determines that the liquid side shut-off valve is properly operating in a case in which the temperature of the refrigerant, detected by the indoor-heat-exchanger-liquid-side temperature sensor after a first predetermined time has elapsed, is equal to or more than a first predetermined temperature, or, in a case in which an absolute value of a difference in temperature between the temperature of the refrigerant detected by the indoor-heat-exchanger-liquid-side temperature sensor and the temperature of the air detected by the indoor temperature sensor after the first predetermined time has elapsed is equal to or less than a first predetermined difference in temperature.

4. The air conditioning system according to claim 2, wherein, in the shut-off valve inspection process, the control processor performs an opening operation of the gas side shut-off valve after the control processor has determined whether the gas side shut-off valve is in a closed state, and determines that the liquid side shut-off valve is properly operating in a case in which the temperature of the refrigerant detected by the indoor-heat-exchanger-liquid-side temperature sensor after a second predetermined time has elapsed is equal to or more than a second predetermined temperature, or, in a case in which an absolute value of a difference in temperature between the temperature of the refrigerant detected by the indoor-heat-exchanger-liquid-side temperature sensor and the temperature of the air detected by the indoor temperature sensor after the second predetermined time has elapsed is equal to or less than a second predetermined difference in temperature.

5. The air conditioning system according to claim 3, wherein the first predetermined temperature is obtained on the basis of the temperature of the refrigerant detected by the indoor-heat-exchanger-liquid-side temperature sensor at start of the shut-off valve inspection process.

6. The air conditioning system according to claim 3, wherein the outdoor unit includes a suction pressure sensor detecting a pressure of the refrigerant on a suction side of the compressor, and wherein the first predetermined temperature is obtained on the basis of the pressure of the refrigerant detected by the suction pressure sensor at the determination of whether the liquid side shut-off valve is operating properly.

7. The air conditioning system according to claim 2, wherein the indoor unit includes an indoor fan supplying the indoor heat exchanger with the air, and wherein the control processor is further configured to perform the shut-off valve inspection process in a state in which the system control part operates the indoor fan.

8. The air conditioning system according to claim 1, wherein the outdoor unit includes a bypass refrigerant pipe returning the refrigerant discharged from the compressor to the suction side of the compressor without sending the refrigerant to the indoor unit, and wherein the control processor is further configured to perform the shut-off valve inspection process in a state in which the refrigerant discharged from the compressor is returning to the suction side of the compressor through the bypass refrigerant pipe.

9. The air conditioning system according to claim 1, wherein the refrigerant circuit includes a plurality of indoor units, each of the plurality of indoor units having the liquid side shut-off valve positioned on the liquid refrigerant pipe, and the gas side shut-off valve positioned on the gas refrigerant pipe, and wherein the control processor is configured to target one or more of the plurality of indoor units and perform the shut-off valve inspection process for the corresponding liquid side shut-off valves and the corresponding gas side shut-off valves of the targeted indoor units.

10. The air conditioning system according to claim 1, wherein the air conditioning system further includes a refrigerant leakage detection device detecting presence or absence of leakage of the refrigerant, and wherein the control processor has a simulation input permission part for permitting opening and closing operation of the liquid side shut-off valve and the gas side shut-off valve to be performed by simulatively inputting a signal indicating presence or absence of leakage of the refrigerant outputted from the refrigerant leakage detection device into the control processor in the shut-off valve inspection process.

11. The air conditioning system according to claim 4, wherein the second predetermined temperature is obtained on the basis of the temperature of the refrigerant detected by the indoor-heat-exchanger-liquid-side temperature sensor at start of the shut-off valve inspection process.

12. The air conditioning system according to claim 4, wherein the outdoor unit includes a suction pressure sensor detecting a pressure of the refrigerant on a suction side of the compressor, and wherein the second predetermined temperature is obtained on the basis of a pressure of the refrigerant detected by the suction pressure sensor at the determination of whether the liquid side shut-off valve properly operates.

13. The air conditioning system according to claim 3, wherein the indoor unit includes an indoor fan supplying the indoor heat exchanger with the air, and wherein the control processor is further configured to perform the shut-off valve inspection process in the state in which the system control part operates the indoor fan.

14. The air conditioning system according to claim 4, wherein the indoor unit includes an indoor fan supplying the indoor heat exchanger with the air, and wherein the control processor is further configured to perform the shut-off valve inspection process in the state in which the system control part operates the indoor fan.

15. The air conditioning system according to claim 5, wherein the indoor unit includes an indoor fan supplying the indoor heat exchanger with the air, and wherein the control processor is further configured to perform the shut-off valve inspection process in the state in which the system control part operates the indoor fan.

16. The air conditioning system according to claim 6, wherein the indoor unit includes an indoor fan supplying the indoor heat exchanger with the air, and wherein the control processor is further configured to perform the shut-off valve inspection process in the state in which the system control part operates the indoor fan.

17. The air conditioning system according to claim 2, wherein the outdoor unit includes a bypass refrigerant pipe returning the refrigerant discharged from the compressor to the suction side of the compressor without sending the refrigerant to the indoor unit, and wherein the control processor is further configured to perform the shut-off valve inspection process in a state in which the refrigerant discharged from the compressor is returning to the suction side of the compressor through the bypass refrigerant pipe.

18. The air conditioning system according to claim 3, wherein the outdoor unit includes a bypass refrigerant pipe returning the refrigerant discharged from the compressor to the suction side of the compressor without sending the refrigerant to the indoor unit, and wherein the control processor is further configured to perform the shut-off valve inspection process in a state in which the refrigerant discharged from the compressor is returning to the suction side of the compressor through the bypass refrigerant pipe.

19. The air conditioning system according to claim 4, wherein the outdoor unit includes a bypass refrigerant pipe returning the refrigerant discharged from the compressor to the suction side of the compressor without sending the refrigerant to the indoor unit, and wherein the control processor is further configured to perform the shut-off valve inspection process in a state in which the refrigerant discharged from the compressor is returning to the suction side of the compressor through the bypass refrigerant pipe.

20. The air conditioning system according to claim 5, wherein the outdoor unit includes a bypass refrigerant pipe returning the refrigerant discharged from the compressor to the suction side of the compressor without sending the refrigerant to the indoor unit, and wherein the control processor is further configured to perform the shut-off valve inspection process in a state in which the refrigerant discharged from the compressor is returning to the suction side of the compressor through the bypass refrigerant pipe.

* * * * *